US005184902A

United States Patent [19]

Harada et al.

[11] Patent Number: 5,184,902

[45] Date of Patent: Feb. 9, 1993

[54] RECORDING APPARATUS HAVING A SINGLE DRIVE SOURCE FOR CONVEYING RECORDING MEANS AND FEEDING RECORDING MEDIUM

[75] Inventors: Tsutomu Harada; Takashi Amari, both of Tokyo, Japan

[73] Assignee: Canon Kabushiki Kaisha, Tokyo, Japan

[21] Appl. No.: 884,475

[22] Filed: May 13, 1992

Related U.S. Application Data

[63] Continuation of Ser. No. 630,851, Dec. 20, 1990, abandoned.

[30] Foreign Application Priority Data

Nov. 26, 1989 [JP] Japan ..... 2-317746
Dec. 26, 1989 [JP] Japan ..... 1-334714
Dec. 26, 1989 [JP] Japan ..... 1-334715

[51] Int. Cl.[5] ..... B41J 23/02

[52] U.S. Cl. ..... 400/185; 400/320; 400/320.1; 400/568; 400/335

[58] Field of Search ..... 400/320, 320.1, 568, 400/322, 323, 185, 186, 335, 355, 555, 569, 570, 577

[56] References Cited

U.S. PATENT DOCUMENTS

| | | | |
|---|---|---|---|
| 4,257,282 | 3/1981 | Wilczewski | 400/320 X |
| 4,313,124 | 1/1982 | Hara | 346/140 R |
| 4,345,262 | 8/1982 | Shirato et al. | 346/140 R |
| 4,379,646 | 4/1983 | Maeda | 400/636 |
| 4,459,054 | 7/1984 | Dollenmayer | 400/185 |
| 4,459,600 | 7/1984 | Sato et al. | 346/140 R |
| 4,461,588 | 7/1984 | Watanabe | 400/144.2 |
| 4,463,359 | 7/1984 | Ayata et al. | 346/1.1 |
| 4,500,217 | 2/1985 | Swindler | 400/320 |
| 4,558,333 | 12/1985 | Sugitani et al. | 346/140 R |
| 4,723,129 | 2/1988 | Endo et al. | 346/1.1 |
| 4,740,796 | 4/1988 | Endo et al. | 346/1.1 |
| 4,920,258 | 4/1990 | Saito | 400/320 X |
| 4,971,464 | 11/1990 | Shikanai | 400/323 |
| 4,986,677 | 1/1991 | Kondo | 400/568 X |
| 5,069,556 | 12/1991 | Sasaki | 400/74 |

FOREIGN PATENT DOCUMENTS

| | | | |
|---|---|---|---|
| 3108689 | 9/1982 | Fed. Rep. of Germany | 400/322 |
| 54-56847 | 5/1979 | Japan . | |
| 49289 | 3/1983 | Japan | 400/320.1 |
| 59-123670 | 7/1984 | Japan . | |
| 59-138461 | 8/1984 | Japan . | |
| 31987 | 2/1985 | Japan | 400/322 |
| 60-71260 | 4/1985 | Japan . | |
| 248378 | 12/1985 | Japan | 400/322 |
| 3980 | 1/1988 | Japan | 400/185 |
| 2140746 | 12/1984 | United Kingdom | 400/185 |
| 8000817 | 5/1980 | World Int. Prop. O. | 400/322 |

OTHER PUBLICATIONS

"Typewriter Power Module for Indexing & Escapement" IBM Tech. Disclosure Bulletin vol. 21, No. 10, Mar. 1979.

"Electronic Slip Compensation For Wire Rope Drives . . . " IBM Tech. Disclosure Bulletin vol. 24, No. 5, Oct. 1981.

*Primary Examiner*—Edgar S. Burr
*Assistant Examiner*—Eric Raciti
*Attorney, Agent, or Firm*—Fitzpatrick, Cella, Harper & Scinto

[57] ABSTRACT

A recording apparatus for recording data on a recording medium including a recording device capable of moving along a passage through which a recording medium passes and recording data on the recording medium; a conveyance device for conveying the recording medium; a moving device for moving the recording device along the conveyance passage; a driving source; a first transmission device for transmitting the power from the driving source to the conveyance device; a second transmission device for transmitting the power from the driving source to the moving device; and a switch for selectively connecting the first transmission device and the drive source while maintaining the connection between the driving source and the second transmission device.

16 Claims, 18 Drawing Sheets

FIG. 17

TABLE IN WHICH INFORMATION ABOUT ACCELERATION, CONSTANT SPEED, DECELERATION (EXAMPLE: 11/120 INCH)

| CONTENTS | DISTANCE OF MOVEMENT (UNIT: 1/120 INCH) | RELATIVE EXCITATION TIME (ms) |
|---|---|---|
| ACCELERATION | 1 | 3.0 |
| | 2 | 5.0 |
| | 3 | 4.6 |
| | 4 | 4.4 |
| CONSTANT SPEED | 5 | 4.2 |
| | 6 | 4.2 |
| DECELERATION | 7 | 4.4 |
| | 8 | 4.6 |
| | 9 | 5.0 |
| | 10 | 6.2 |
| | 11 | 7.5 |

FIG. 18

COMMON CONTROL TABLE WITH RESPECT TO DISTANCE LONGER THAN 12/120 INCH
( EXAMPLE : FOR MOVING n / 120 INCH )

| CONTENTS | DISTANCE OF MOVEMENT (UNIT : 1/ 120 INCH ) | RELATIVE EXCITATION TIME ( ms ) |
|---|---|---|
| ACCELERATION | 1 | 3.0 |
| | 2 | 5.0 |
| | 3 | 4.6 |
| | 4 | 4.4 |
| | 5 | 4.2 |
| | 6 | 4.0 |
| CONSTANT SPEED | 7 ~ n - 6 | 3.9 |
| DECELERATION | n - 5 | 4.1 |
| | n - 4 | 4.3 |
| | n - 3 | 4.6 |
| | n - 2 | 5.2 |
| | n - 1 | 6.2 |
| | n | 7.5 |

FIG. 20

EXCLUSIVE CONTROL TABLE FOR REMOVING BACKLASH

| CONTENTS | DISTANCE OF MOVEMENT (UNIT : 1/120 INCH ) | RELATIVE EXCITATION TIME ( ms ) |
|---|---|---|
| EXCLUSIVE USE | 1 | 17.0 |
| | 2 | 25.0 |

FIG. 19

INDIVIDUAL CONTROL TABLE FOR
EACH DISTANCE 1/120 ~ 12/120 INCH
( UNIT OF RELATIVE EXCITATION TIME : ms )

| | DISTANCE OF MOVEMENT ( UNIT : 1/120 INCH ) | | | | | | | |
|---|---|---|---|---|---|---|---|---|
| | 5 | 6 | 7 | 8 | 9 | 10 | 11 | 12 |
| 1 | 3.0 | 3.0 | 3.0 | 3.0 | 3.0 | 3.0 | 3.0 | 3.0 |
| 2 | 5.0 | 5.0 | 5.0 | 5.0 | 5.0 | 5.0 | 5.0 | 5.0 |
| 3 | 5.0 | 4.6 | 4.6 | 4.6 | 4.6 | 4.6 | 4.6 | 4.6 |
| 4 | 5.5 | 5.0 | 4.6 | 4.4 | 4.4 | 4.4 | 4.4 | 4.4 |
| 5 | 6.5 | 5.5 | 5.0 | 4.6 | 4.4 | 4.2 | 4.2 | 4.2 |
| 6 | – – | 6.5 | 5.5 | 5.0 | 4.6 | 4.4 | 4.2 | 4.0 |
| 7 | | – – | 6.5 | 5.5 | 5.0 | 4.6 | 4.4 | 4.2 |
| 8 | | | – – | 6.5 | 5.5 | 5.0 | 4.6 | 4.4 |
| 9 | | | | – – | 6.5 | 6.2 | 5.0 | 4.6 |
| 10 | | | | | – – | 7.5 | 6.2 | 5.2 |
| 11 | | | | | | – – | 7.5 | 6.2 |
| 12 | | | | | | | – – | 7.5 |

RECORDING APPARATUS HAVING A SINGLE DRIVE SOURCE FOR CONVEYING RECORDING MEANS AND FEEDING RECORDING MEDIUM

This application is a continuation of application Ser. No. 07/630,851 filed Dec. 20, 1990, now abandoned.

BACKGROUND OF THE INVENTION

1. Field of the Invention

The present invention relates to a serial recording apparatus having recording means movable along the passage through which the recording sheet is moved. More particularly, the present invention relates to a recording apparatus capable of conveying the recording means and the recording sheet by one driving source.

2. Description of the Prior Art

Hitherto, in accordance with the wide use of word processors, a variety of printing devices have been developed. A daisy wheel type printing device has been available which is arranged in such a manner that a daisy wheel and a hammer are mounted on a carriage which is movable in the recording direction. When the daisy wheel is rotated, a desired type is selected, the type being then struck by the hammer. As a result, the ink on an ink ribbon is transferred to a recording sheet so that the data can be recorded.

In the above-described printing apparatus, a plurality of motors are employed to operate each of the components in such a manner that a wheel motor is used to rotate the daisy wheel, a ribbon motor is used to supply the ink ribbon, a carriage motor is used to move the carriage and a conveyance motor is used to convey the recording sheet.

However, the use of a plurality of motors to operate each of the components give rise to a problem in that the number of elements is unnecessarily increased. As a result, the manufacturing cost is excessive and the size of the apparatus cannot be reduced.

Furthermore, a major portion of the printing apparatus is arranged to move the carriage in a unit of one character (=10/120 inch) or a half character (=5/120 inch) to print each character. Therefore, information included in a work area which shows the present position of the carriage, that is, the carriage which has been moved in a unit of the half character, that is, 5/120 inch as an alternative to the unit of 1/120 inch which is the minimum resolution of the printing apparatus.

If the movement of the carriage and the conveyance of the sheet are performed by one driving source as described above, the amount of movement of the carriage at the time of conveying the sheet is determined by the gear ratio in the transmission from the driving source to the sheet conveyance device and the amount of the movement of the sheet. Therefore, the above-described value is not always a unit equal to a half character.

Therefore, the carriage position is displaced by a degree less than the half character with each conveyance action of the sheet. However, the above-described displacement cannot be corrected in an apparatus having no means for moving it by a degree smaller than the half character. If the minimum resolution of the carriage is changed into a unit of 1/120 inch in order to correct the displacement, the mechanism becomes too complicated. The reason for this lies in that one line of print is constituted by 120 characters in the case of a printing apparatus having one line of print equal to 10 inches in length. Therefore, the carriage can be positioned at 240 positions when movable in half character units. The numeral of 240 can be expressed by a variable of one byte. However, when the carriage is movable in 1/120 inch units, 1200 positions exist, the numeral 1200 being able to be expressed by a variable of 2 bytes. That is, the present position of the carriage, the destined position, and a variety of local operations variables must be converted from conventional 1-byte variables to 2-byte variables. Furthermore, that conversion must meet the following conditions:

(1) The RAM has an empty region in which the size of the variable can changed.

(2) The method of processing all of the portions using the above-described variable must be changed from the 1-byte operation to the 2-byte operation.

(3) The ROM has an empty region in which the above-described change (2) can be performed.

As a result, it is difficult to change the minimum resolution of a printing apparatus from 5/120 inch to 1/120 inch.

SUMMARY OF THE INVENTION

An object of the invention is to provide a recording apparatus the size of which can be reduced since the number of elements is reduced.

Another object of the invention is to provide a recording apparatus in which the movement of the recording means and the conveyance of the recording sheet are realized by the same driving source and the recording means can be accurately moved and the recording sheet can be precisely conveyed.

Another object of the present invention is to provide a recording apparatus capable of moving the carriage and conveying the sheet by the same driving source wherein, when a sheet is conveyed, the carriage is moved and the control means controls the driving source so as to move the carriage to a desired position after the sheet has been conveyed, compensating for the previous movement of the carriage.

Another object of the invention is to provide a recording apparatus arranged in such a manner that the power transmission means is not separated from the driving source so that the carriage is not moved undesirably by the action of a switch, or shifting means and the carriage can thereby be accurately moved to a desired position.

Another object of the invention is to provide a recording apparatus in which, if the movement of the carriage is smaller than the original minimum resolution as a result of the sheet conveyance process, it can be corrected at the time of the movement of the carriage and the conveyance of the sheet.

According to one aspect of the present invention, a recording apparatus includes recording means capable of moving along a recording medium passage, means for conveying the recording medium, and means for moving the recording means. A driving source generates driving power which is transmitted through first and second transmission means. The first transmission means transmits power to the conveyance means and the second transmission means transmits the power to the moving means. Switch means selectively connects and disconnects the first transmission means and the second transmission means while maintaining a connection between the driving source and the second transmission means.

According to another aspect of the present invention, the recording apparatus includes a carriage capable of moving along a recording sheet passage, recording means mounted on the carriage and a driving source for generating driving force. The apparatus further includes power transmission means for transmitting the drive force to a sheet conveyance means and switch means for selectively transmitting the force to the sheet conveying means via the power transmitting means. The driving source also supplies force to the carriage moving means. Control means controls both a sheet conveyance process and a carriage moving process. In the sheet conveyance process, the recording sheet is conveyed by transmitting the force from the driving source to the sheet conveyance means via the switch means. In the carriage moving process, the switch means does not transmit the force to the sheet conveyance means and the driving source is operated so as to correct the amount of movement of the carriage in the sheet conveyance process.

According to yet a further aspect of the present invention, a recording apparatus comprises a carriage capable of moving along a recording sheet passage, recording means mounted on the carriage and a driving source for generating driving force. The apparatus further includes power transmission means for transmitting the drive force to a sheet conveyance means and switch means for selectively transmitting the force to the sheet conveying means via the power transmitting means. The driving source also supplies force to the carriage moving means. Control means controls both a sheet conveyance process and a carriage moving process. In the sheet conveyance process, the recording sheet is conveyed by transmitting the force from the driving source to the sheet conveyance means via the switch means. In the carriage moving process, the switch means does not transmit the force to the sheet conveyance means when the carriage is moved to a desired recording position after the sheet conveyance process. Also in the carriage moving process, the driving source is operated to a degree corresponding to the difference between the distance the carriage moved in the sheet conveyance process and the distance from a stop position of the carriage before the sheet conveyance process to the desired recording position.

According to still a further aspect of the present invention, a recording apparatus comprises a carriage capable of moving along a recording sheet passage, recording means mounted on the carriage and a driving source for generating driving force. The apparatus further includes power transmission means for transmitting the drive force to a sheet conveyance means and switch means for selectively transmitting the force to the sheet conveying means via the power transmitting means. The driving source also supplies force to the carriage moving means. In a sheet conveyance process, the recording sheet is conveyed by transmitting the force from the driving source to the sheet conveyance means via the switch means. Control means controls a sheet conveyance process, a correction process and a carriage movement process. In the sheet conveyance process, a recording sheet is conveyed by transmitting the force from the driving source to the sheet conveyance means via the switch means. In the correction process, the switch means does not transmit the force to the sheet conveyance means when the carriage is moved to a desired recording position after the sheet has been conveyed, and the drive source is reversibly operated to a degree corresponding to the distance the carriage moves in the sheet conveyance process. In the carriage movement process, after the correction process, the driving source is operated to a degree corresponding to the distance from a carriage stop position where the carriage is positioned before the sheet conveyance process to a desired recording position.

Other and further objects, features and advantages of the invention will be appear more fully from the following description.

BRIEF DESCRIPTION OF THE DRAWINGS

FIGS. 17 to 20 illustrate examples of tables for use in the fifth and the sixth embodiments.

DESCRIPTION OF THE PREFERRED EMBODIMENTS

Preferred embodiments of the present invention will be described with reference to the drawings, wherein the above-described means is applied to a recording apparatus for recording data by rotating a printing element of a daisy wheel type.

First Embodiment

Figure 1:
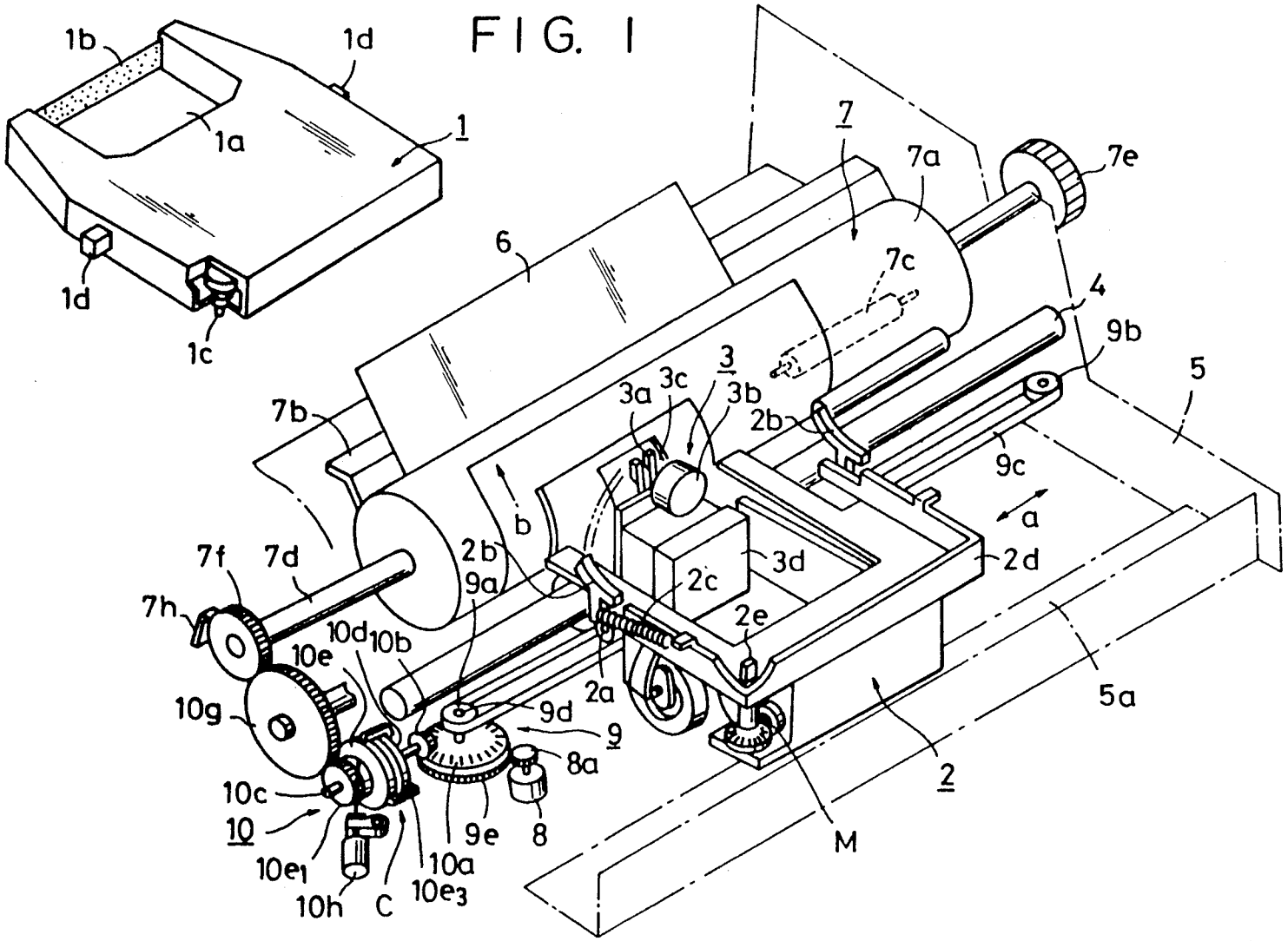
FIG. 1 is a perspective structural view which illustrates an embodiment of a daisy wheel recording apparatus according to the present invention.
Figure 2A:
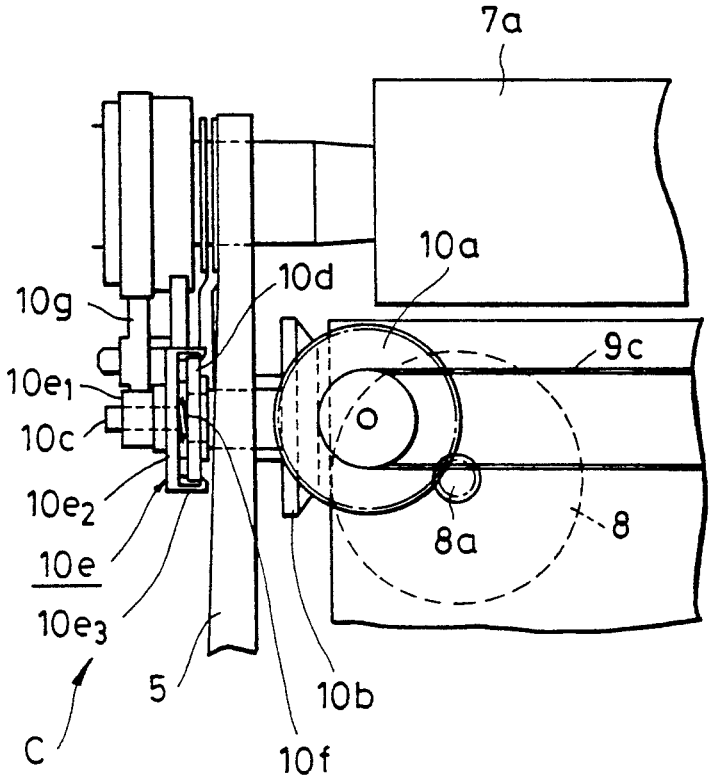
FIGS. 2 (*a*) and 2 (*b*) are respectively a schematic plan view and a side elevational view of a clutch portion.
Figure 2B:
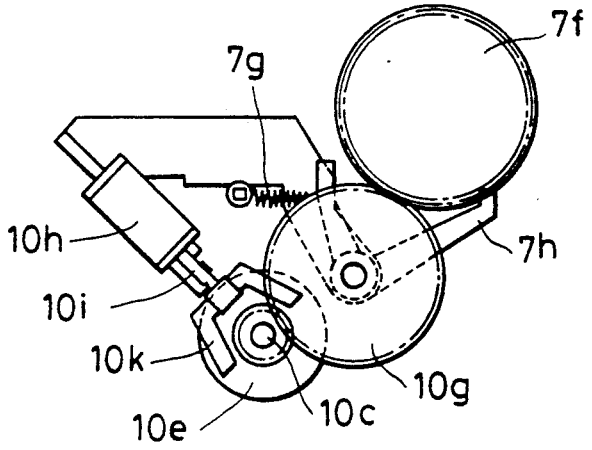

FIG. 1 is a perspective view which illustrates the overall body of a recording apparatus. FIG. 2 illustrates an essential portion of a switching means.

Overall Structure

First, the overall structure of the apparatus will be described. An ink ribbon cassette 1 is detachably fitted to a carriage 2, the carriage 2 having recording means 3 mounted thereon. Furthermore, the carriage 2 is reciprocatively moved in a direction designated by an arrow a shown in FIG. 1 thanks to the guiding action realized by a guide shaft 4 and an end surface 5*a* of the body frame 5. When the carriage 2 is moved to a desired position and the recording means 3 is operated, data can be recorded on a recording sheet 6. After printing one line of data, the recording sheet 6 is conveyed in a direction designated by an arrow b by a sheet conveyance means 7.

The above-described carriage 2 is moved by a carriage moving means 9 which is connected to a carriage motor 8, serving as a drive source, via a gear 8*a*. A platen roller 7*a* constituting a sheet conveyance means 7 is arranged in such a manner that the rotational force of the motor 8 can be transmitted/stopped by a switch means 10.

The structure of each of the elements will specifically be described.

The ink ribbon cassette 1 has a recessed portion 1*a* at the central portion of the front portion of its container. An elongated ink ribbon 1*b* (for example a so-called "one-time" carbon ink ribbon) is wound on a supply spool (omitted from illustration) disposed in the container in such a manner that it can be wound on a winding spool (omitted from illustration) while moving through the above-described recessed portion 1*a*. The winding spool has a winding shaft to be described later and to which a rotation transmission roller 1*c* is engaged so that the ink ribbon 1*b* is wound when the winding shaft is rotated. Furthermore, the cassette 1 has, on two sides thereof, positioning bosses 1*d* serving as the positioning reference when the cassette 1 is loaded to the carriage 2.

Carriage

The carriage is arranged to move with the recording means 3 mounted thereto and the ink ribbon cassette 1 fitted thereto. The carriage 2 has, on two end portions thereof, hooks 2*b*, each of which is able to rotate relative to a shaft 2*a*, the hooks 2*b* being urged by tension springs 2*c*. When the positioning boss 1*d* of the ink ribbon cassette 1 is fastened to the hook 2*b*, the ink ribbon cassette 1 is abutted against a standing wall 2*d* of the carriage 2 and is thereby secured. At this time, the ink ribbon 1*b* located in the recessed portion 1*a* is positioned between a daisy wheel 3*a* to be described later and the recording sheet 6.

A winding shaft 2*e* is provided at a predetermined position of the carriage 2 so that, when the ink ribbon cassette 1 is loaded on the carriage 2, the power transmission roller 1*c* is fastened to the winding shaft 2*e*. Furthermore, a ribbon motor M is connected to the above-described winding shaft 2*c* so as to wind the ink ribbon 1*b* to the winding spool when it is rotated by the motor M.

The carriage 2 is slidably engaged to a guide shaft 4 fastened to the body frame 5 so that the carriage 2 is able to move along the guide shaft 4 and the frame end 5*a*.

Recording Means

The recording means 3 is arranged to use a daisy printing type element according to this embodiment. A daisy wheel 3*a* and a hammer 3*c* operated by a solenoid 3*b* are mounted on the carriage 2.

The daisy wheel 3*a* is arranged in such a manner that types are arranged radially relative to a rotational shaft (omitted from illustration) so that, when a wheel motor 3*d* connected to the rotational shaft is rotated, the wheel is rotated. Therefore, when a desired type is aligned with the hammer 3*c* by rotating the daisy wheel 3*a* and the ink ribbon 1*b* is struck by the hammer 3*c* through the aligned type, the type character is printed on the recording sheet 6, the reverse side of which is supported by the platen roller 7*a*.

Sheet Conveyance Means

As shown in FIG. 1, the sheet conveyance means 7 is arranged in such a manner that the platen roller 7*a* is disposed at a position within the range of impact of the operation shaft of the hammer 3*c* and within the range in which the carriage 2 is arranged to move. The platen roller 7*a* is arranged to rotate by the rotational force supplied from the carriage motor 8. A guide 7*b* is fastened so as to surround the platen roller 7*a* and a plurality of pinch rollers 7*c* are forcibly positioned in contact with the roller 7*a*.

Therefore, the rotation of the platen roller 7*a* in cooperation with the pinch rollers 7*c* cause the recording sheet 6 to be guided by the guide plate 7*b*. As a result, the recording sheet 6 passes between the platen roller 7*a* and the ink ribbon 1*b* in a direction designated by arrow b shown in FIG. 1.

A hand knob 7*e* is fastened to an end portion of a shaft 7*d* of the platen roller 7*a*, while a platen gear 7*f* is fastened to the other end portion, the gear 7*f* being provided with a detent mechanism. That detent mechanism is arranged in such a manner that a detent portion is formed in the platen gear 7*f* and a detent lever 7*h*, which is urged by a tension spring 7*g*, is engaged to the recessed portion of the detent portion. As a result, the platen roller 7*a* can be rotated in an angular unit corresponding to the interval between the teeth of the detent portion. That is, the unit of the conveyance of the recording sheet 6 is determined by the above-described detent portion. Furthermore, even if a clutch, to be described later, is released and the platen roller 7*a* is thereby brought to a free state, the undesired rotation of the platen roller 7*a* is prevented by the action of the detent mechanism.

Carriage Movement Means

The carriage movement means 9 acts to move the carriage 2 along the guide shaft 4. According to this embodiment, a timing belt 9*c* is arranged between a drive pulley 9*a* and a follower pulley 9*b*, the belt 9*c* being connected to the carriage 2. A gear 9*e* is fastened to the pulley shaft 9*d* of the drive pulley 9*a* and a motor gear 8*a* of the carriage motor 8 is engaged to the gear 9*e*. As a result, when the carriage motor is rotated forwardly/reversely, the carriage 2 reciprocates along the guide shaft 4.

Switch Means

Then, the switch means 10 acts to selectively transmit the rotational force of the carriage motor 8 to the conveyance means 7.

As shown in FIGS. 2 (*a*) and 2 (*b*) which respectively are a schematic front elevational view and a schematic side elevational view, a bevel gear 10*a* is fastened to the pulley shaft 9*d*. A bevel gear 10*b* supported by the frame 5 is engaged to the gear 10*a* so that the rotational force of the carriage motor 8 is perpendicularly transmitted.

Furthermore, a clutch C is fastened to the gear shaft 10*c* of the bevel gear 10*b*. The clutch C is arranged in such a manner that a serration gear 10*d* is secured to the gear shaft 10*c* and a clutch gear 10*e* is loosely fitted to the gear shaft 10*c* in such a manner that it is able to slide in the axial direction of the gear shaft 10*c* and rotate in the direction of rotation of the gear shaft 10*c*. The above-described two gears 10*d* and 10*e* are urged by a compression spring 10*f* disposed therebetween. The clutch gear 10*e* comprises a gear portion $10_{e1}$ and a disc portion $10_{e2}$. A claw portion $10_{e3}$ formed in the periphery portion of the disc portion $10_{e2}$ is slidably fastened to the periphery portion of the serration gear 10*d*. Furthermore, the two gears 10*d* and 10*e* approach and separate by the urging force of the compression spring 10*f*.

Figure 3:
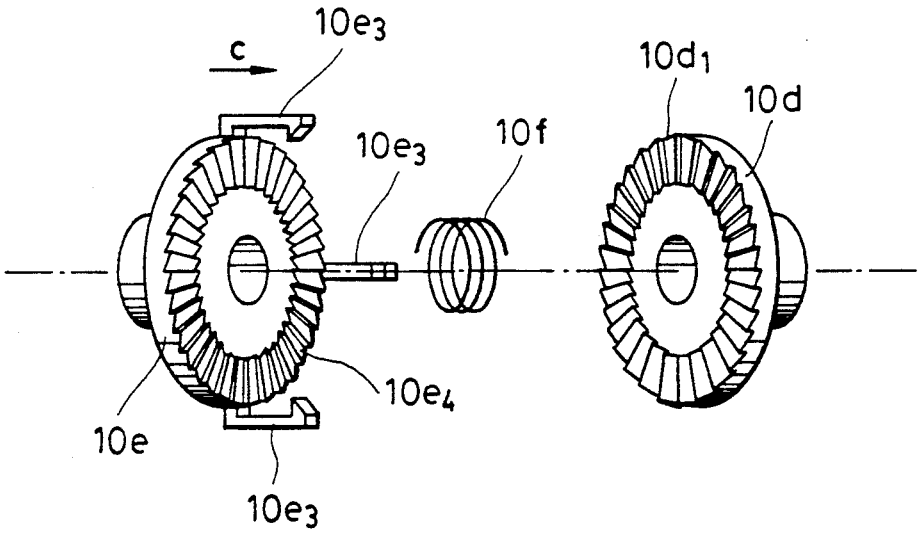
FIG. 3 is a structural view of the engagement of the clutch.

The serration gear 10*d* and the clutch gear 10*e* respectively have, on their confronting surfaces, saw-tooth-like ratchet teeth $10_{d1}$ and $10_{e4}$ as shown in FIG. 3. As a result, when the clutch gear 10*e* slides in the direction designated by an arrow c shown in FIG. 3 and is thereby brought into closely contact with the serration gear 10*d*, the ratchet teeth $10_{d1}$ and $10_{e4}$ are engaged with each other.

Therefore, when the above-described two gears 10*d* and 10*e* are separated from each other, the rotational force of the carriage motor 8 is not transmitted to the clutch gear 10*e* while idly rotating the serration gear 10*d*. When the clutch gear 10*e* slides in the direction designated by the arrow c and the ratchet teeth $10_{d1}$ and $10_{e4}$ engage each other, the rotational force of the carriage motor 8 is transmitted from the serration gear 10*d* to the clutch gear 10*e*. As a result, the above-described two gears are integrally rotated.

As shown in FIG. 2, an intermediate gear 10*g* engages the gear portion $10_{e1}$ of the clutch gear 10*e*. The platen gear 7*f* secured to the roller shaft 7*d* of the platen roller 7*a* is engaged to the intermediate gear 10*g*.

Therefore, when the rotational force of the carriage motor 8 is transmitted to the clutch gear 10*e*, the platen roller 7*a* is rotated. When the transmission of that rotational force is stopped, the rotation of the platen roller 7*a* is stopped.

Figure 4:
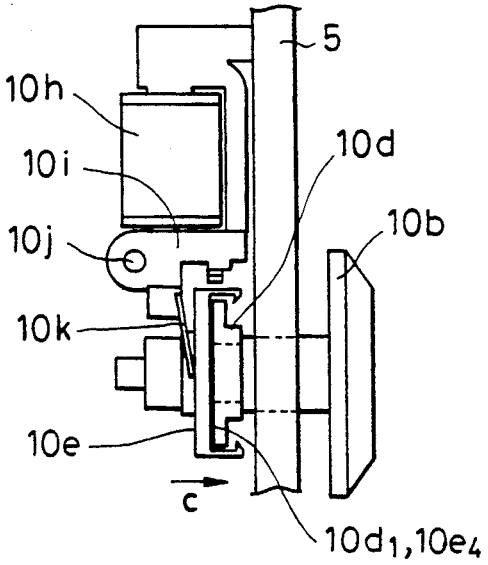
FIGS. 4 (*a*) and 4 (*b*) illustrate the state where the clutch is engaged/released.
Figure 4:
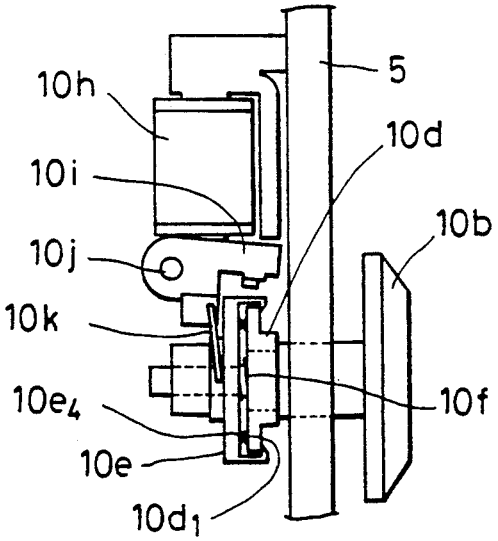

The switching of the clutch C is performed by a solenoid. Specifically, a solenoid 10*h* is, as shown in FIGS. 4 (*a*) and 4 (*b*), fastened to the body frame 5. When the solenoid 10*h* is turned on/off, a solenoid lever 10*i* rotates relative to a shaft 10*j*. Furthermore, a clutch lever 10*k* is fastened to the solenoid lever 10*i*. Therefore, when the solenoid 10*h* is, as shown in FIG. 4 (*a*), turned on, the solenoid lever 10*i* is attracted so that the clutch gear 10*e* slides in the direction designated by the arrow c. As a result, the ratchet teeth $10_{d1}$ and $10_{e4}$ are engaged with each other. When the solenoid 10*h* is turned off as shown in FIG. 4 (*b*), the solenoid lever 10*i* is released. As a result, the clutch gear 10*e* is separated from the serration gear 10*d* by the urging force of the compression spring 10*c*. Therefore, the engagement between the ratchet teeth $10_{d1}$ and $10_{e4}$ is released.

That is, when the solenoid 10*h* is turned on, the rotational force of the carriage motor 8 is, via the clutch C, transmitted to the platen roller 7*a*. As a result, the roller 7*a* is rotated, causing the recording sheet 6 to be conveyed. When the solenoid 10*h* is turned off, the rotational force of the carriage motor 8 is not transmitted by the clutch C, thus not causing the rotation of the platen roller 7*a*. As a result, both the movement of the carriage 2 and the operation of the sheet conveyance means 7 can be performed by one motor 8.

Second Embodiment

The structure according to the above-described first embodiment is arranged in such a manner that the rotational force of the carriage motor 8 is transmitted to the sheet conveyance means 7 via the serration clutch C. According to a second embodiment, another switch means is employed. The same elements as those according to the first embodiment are given the same reference numerals and their descriptions are omitted here.

Figure 5A:
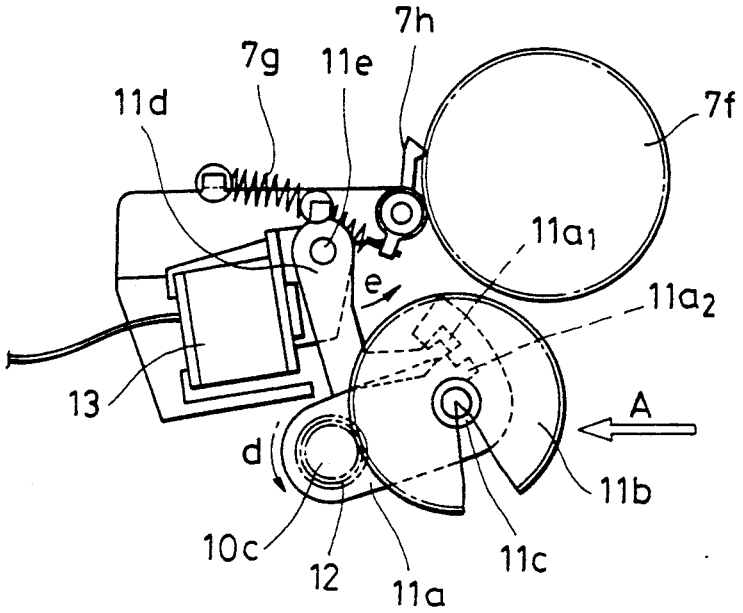
FIGS. 5 (*a*) and 5 (*b*) illustrate the state where the rotational force of the carriage motor is stopped to be supplied to the platen roller by a clutch according to a second embodiment.
Figure 5B:
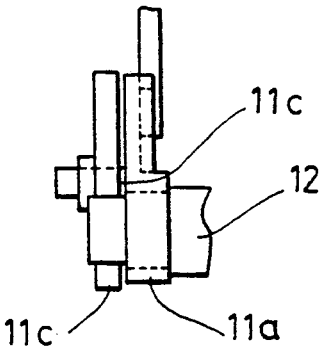

FIG. 5 (*a*) is a schematic side elevational view of a switch means 11 according to the second embodiment. FIG. 5 (*b*) is a cross sectional view taken along line A of FIG. 5 (*a*).

Referring to the drawings, reference numeral 12 represents a transmission gear fastened to the gear shaft 10*c* of the bevel gear 10*b* connected to the carriage motor 8. When the carriage motor 8 is rotated, the transmission gear 12 is rotated.

An idle gear lever 11*a* is fitted within the gear shaft 10*c*, the lever 11*a* being fitted rotatably relative to the gear shaft 10*c*. An intermediate gear 11*b* is fastened to the rotary side of the idle gear lever 11*a*, the intermediate gear 11*b* being engaged to the transmission gear 12. That is, the intermediate gear 11*b* is arranged to be a planetary gear with respect to the transmission gear 12 serving as a sun gear, the planetary gear rotates around the gear 12 while engaging with this gear 12.

As shown in FIG. 5 (*b*), a bent washer 11*c* is fastened between the lever 11*a* and the intermediate gear 11*b*. As a result, the intermediate gear 11*b* is always in frictional contact with the lever 11*a* as a result of the urging force of the washer 11*c*. When the transmission gear 12 is rotated due to the above-described friction, the lever 11*a* is rotated in the same direction. Furthermore, when the transmission gear 12 is rotated in the direction designated by an arrow d shown in FIG. 5 (*a*) and the lever 11*a* is rotated in the same direction, the intermediate gear 11*b* engages with the platen gear 7*f*. When the lever 11*a* is rotated in the reverse direction, the above-described gears disengage.

Figure 6:
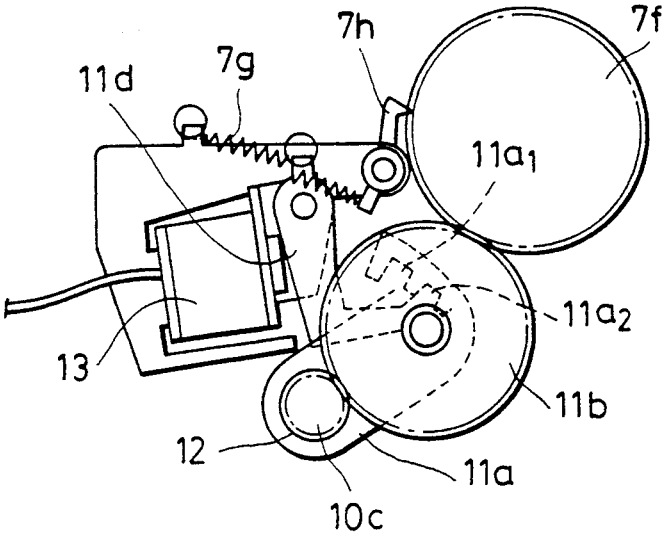
FIG. 6 illustrates a state where the platen roller is operated.

Two recessed portions $11_{a1}$ and $11_{a2}$ are formed at the front portion of the rotation of the lever 11*a*. The front portion of a solenoid lever 11*d* is fitted within the two recessed portions $11_{a1}$ and $11_{a2}$. The solenoid lever 11*d* is capable of rotating relative to the shaft 11*e* and is also urged by a spring (omitted from illustration) in a direction designated by an arrow e shown in FIG. 5 (*a*). Furthermore, when the front portion of the rotation of the solenoid lever 11*d* is, as shown in FIG. 5 (*a*), fitted within the recessed portion $11_{a1}$ of the lever 11*a*, the intermediate gear 11*b* and the platen gear 7*f* are secured while being separated from each other. When the front portion of the solenoid lever 11*d* is fitted within the recessed portion $11_{a2}$ as shown in FIG. 6, the intermediate gear 11*b* and the platen gear 7*f* are secured while being engaged with each other.

Figure 7:
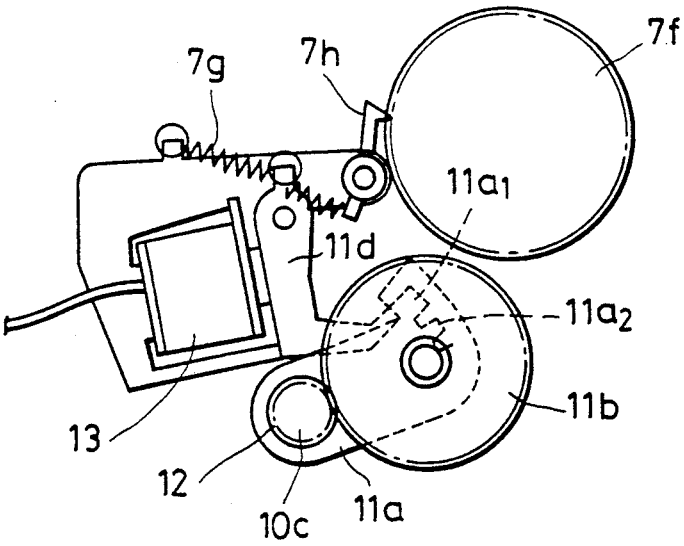
FIG. 7 illustrates a state where the solenoid lever is attracted.

When the solenoid 13 is turned on, the front portion of the solenoid lever 11*d* is rotated and, as shown in FIG. 7, separated from the recessed portion $11_{a1}$ or $11_{a2}$ since it is attracted by the solenoid 13.

Therefore, when the recording sheet 6 is not to be conveyed, the solenoid lever 11*d* is fitted into the recessed portion $11_{a1}$ of the idle gear lever 11*a* so as to separate the intermediate gear 11*b* and the platen gear 7*f* from each other. In this state, even if the carriage motor 8 is rotated, the rotational force is not transmitted to the platen gear 7*f*. Therefore, the platen roller 7 is not rotated.

When the recording sheet 6 is to be conveyed, the solenoid 13 is turned on so as to separate the solenoid lever 11*d* from the recessed portion $11_{a1}$. Then, the carriage motor 8 is rotated so as to rotate the transmission gear 12 in the direction designated by the arrow d shown in FIG. 5 (*a*). As a result, the intermediate gear 11*b* and the platen gear 7*f* are engaged each other. When the solenoid 13 is turned off in this state, the solenoid lever 11*d* is fitted into the recessed portion $11_{a2}$ of the idle gear lever 11*a* so that the gears 11*b* and 12 are secured while engaging each other. Therefore, when the platen 8 is rotated in this state, the rotational force is transmitted to the platen gear 7*f*. As a result, the platen roller 7*a* is rotated so that the recording sheet 6 is conveyed.

In the case where the clutch arranged as described above is used, the carriage 2 can be moved and the recording sheet 6 can be conveyed by the carriage motor 8.

Another embodiment capable of moving the recording means and conveying the recording sheet by the same driving source will be described. The same elements as those according to the above-described embodiment are given the same reference numerals and their descriptions are omitted here.

Figure 8:
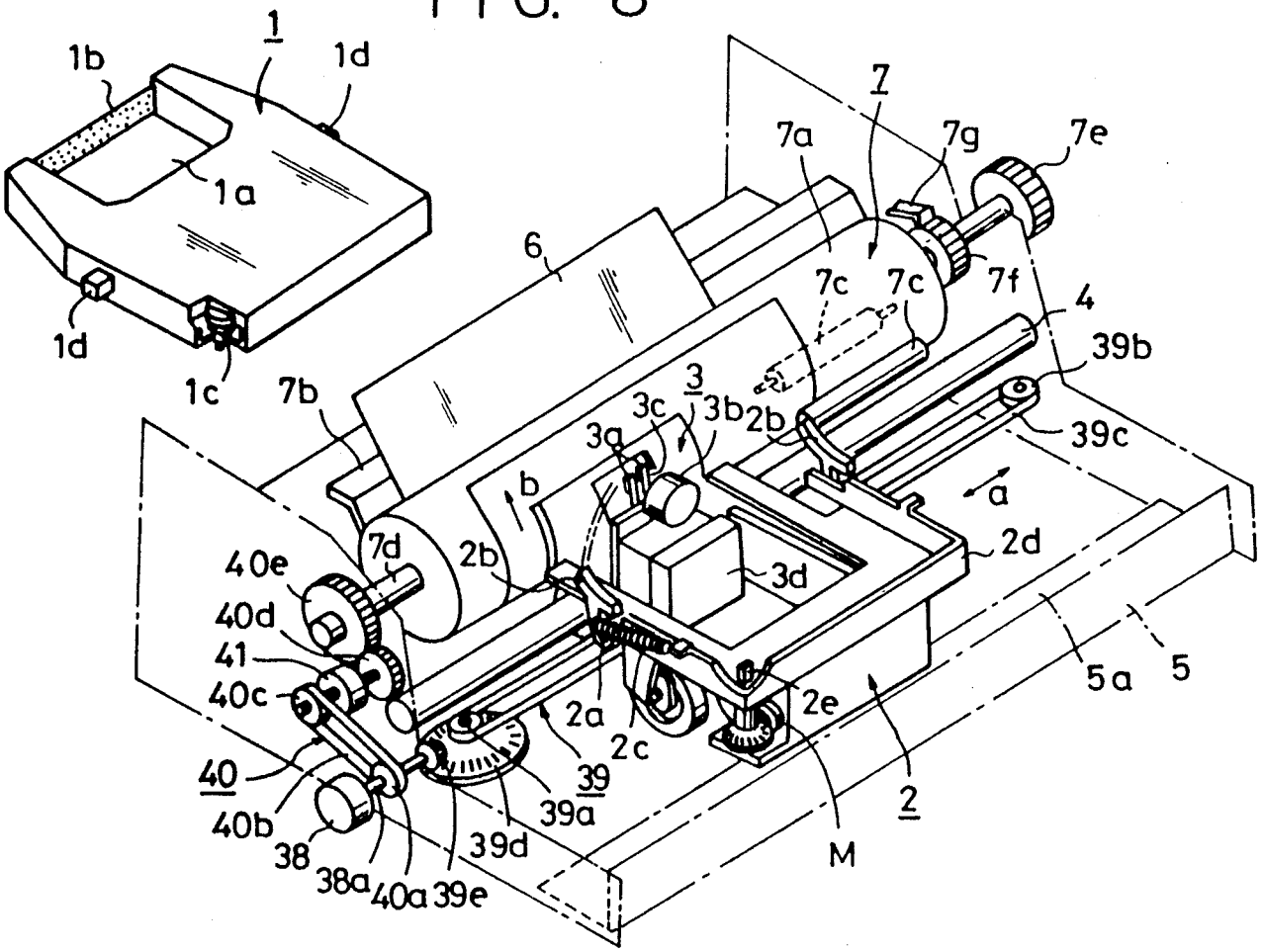
FIG. 8 is a perspective view which illustrates a third embodiment of the recording apparatus according to the present invention.
Figure 9:
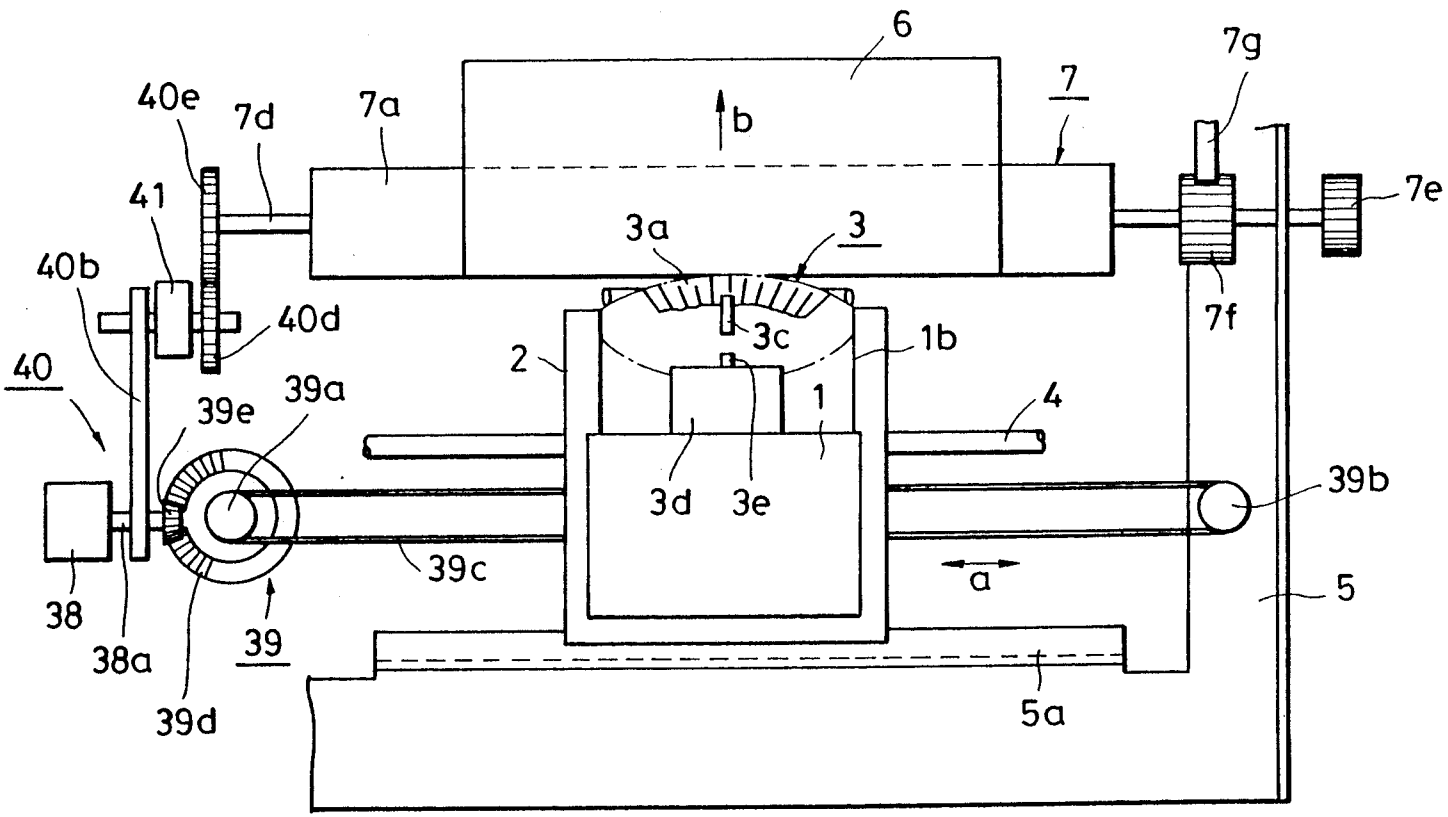
FIG. 9 is a schematic plan view of the apparatus.

FIG. 8 is a perspective view which illustrates the overall body of the recording apparatus. FIG. 9 is a schematic plan view.

According to this embodiment, the carriage 2 is arranged to be movable by a carriage moving means 39 connected to a carriage motor 38, serving as the driving source, via a gear. The rotational force of the motor 38 is divided and transmitted by a power transmission means 40 to the platen roller 7*a* constituting the sheet conveyance means 7, the platen roller 7*a* being selectively rotated in accordance with the release/engagement of the clutch 41 serving as the switch means. As a result, when the carriage motor 38 is rotated while engaging the clutch 41, the platen roller 7*a* is rotated so that the recording sheet 6 is conveyed. Furthermore, the carriage 2 is moved. When the carriage motor 38 is rotated while releasing the clutch 41, only the carriage 2 is moved.

The carriage 2 is, by a control means, moved to a desired position in consideration of the amount of the movement of the carriage at the time of the conveyance of the sheet.

The above-described type daisy wheel 3*a* is formed in such a manner that types are radially arranged relative to the rotational shaft 3*e* so that it is rotated when the wheel motor 3*d* connected to the rotational shaft 3*c* is rotated.

The hand knob 7*e* is fastened to an end portion of the shaft 7*d* of the platen roller 7*a* and a platen detent mechanism is as well as provide for the same. The platen detent mechanism is arranged in such a manner that a pulley 7*f* having triangular teeth on the outer surface thereof is provided on the shaft 7*d*.

When the spring member 7*g* engages a recessed portion between teeth of the pulley 7*f*, the undesired rotation of the platen roller 7*a* is prevented even if the transmission of the rotational force from the carriage motor 38 is stopped and the platen roller 7*a* can be freely rotated.

Various means of the recording apparatus will now be described.

Carriage Moving Means

The carriage movement means 39 acts to move the carriage 2 along the guide shaft 4. According to this embodiment, a timing belt 39*c* is arranged between a drive pulley 39*a* and a follower pulley 39*b*, the belt 39*c* being connected to the carriage 2. A bevel gear 39*d* is fastened to the rotational shaft of the drive pulley 39*a*. A bevel gear 39*e* fastened to a motor shaft 38*a* of the carriage motor 38 is engaged to the gear 39*d*. Therefore, when the carriage motor 38 is rotated forwardly/-reversely, the carriage 2 moves along the guide shaft 4.

Power Transmission Means

A power transmission means 40 acts to divide and transmit the rotational force of the carriage motor 38 for moving the carriage 2 to the platen roller 7*a*. Therefore, a motor pulley 40*a* is fastened to the motor shaft 38*a* so that the rotational force of the pulley 40*a* is transmitted to a feed pulley 40*c* via a timing belt 40*b*. A gear 40*d* is fastened to the shaft of the feed pulley 40*c* via a clutch 41. The gear 40*d* is engaged to a platen gear 40*c* fastened to the shaft 7*d* of the platen roller 7*a*.

Switch Means

The switch means selectively transmits the rotational force of the carriage motor 38 to the platen roller 7*a*. According to this embodiment, it comprises an electromagnetic clutch 41 as described above.

The clutch 41 is released/engaged in response to a signal transmitted from a control means to be described later. When the clutch is engaged, the feed pulley 40*c* and the gear 40*d* are connected to each other so that the rotational force of the carriage motor 8 is transmitted to the platen roller 7*a*. When the same is released, the feed pulley 40*c* and the gear 40*d* are separated from each other so that the rotational force of the carriage motor 38 is not transmitted to the platen roller 7*a*.

Control Means

A control means for controlling the operation of each of the above-described elements at the time of the recording operation will now be described.

Figure 10:
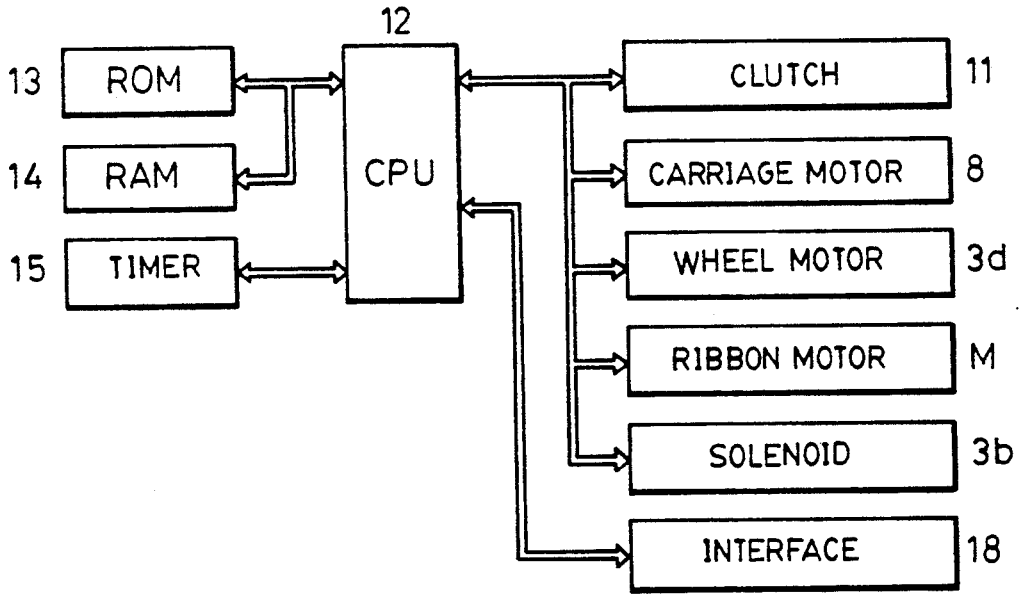
FIG. 10 is a structural block diagram of the control means.

FIG. 10 is a block diagram which illustrates the control portion. Referring to FIG. 10, a ROM 13, a RAM 14 and a timer 15 and the like are connected to a CPU 12 via a CPU bus.

The CPU 12 is a central processing unit acting to read a program and various data items from the ROM 13 or the like so that the necessary calculations and determinations and various controls are performed.

The ROM 13 is a read only memory which stores an algorithm to be described later for operating the CPU 12 in the form of data items.

The RAM 14 is a read/write memory comprising a working area for temporarily storing the data for the command of the CPU 12 and results of the calculations and a buffer area for storing a variety of data items supplied from an interface 18 or the like.

A timer 15 is connected to the CPU 12 by the CPU bus so as to count the time for determining the timing for operating each of the elements in a sequence to be described later.

The interface 18 is provided for the purpose of establishing a data communication with external equipment. The CPU 12 reads the external print command via the interface 18 so as to issue a command to commence printing.

The CPU 12 processes signals from the ROM 13, RAM 14 and the timer 15 and the like and transmits a release/engagement signal to the clutch 11 and signals for driving the carriage motor 38, the wheel motor 3*d* and the ribbon motor M and the like. Furthermore, the CPU 12 transmits a signal for driving the solenoid 3*b* for operating the hammer 3*c*.

Figure 11:
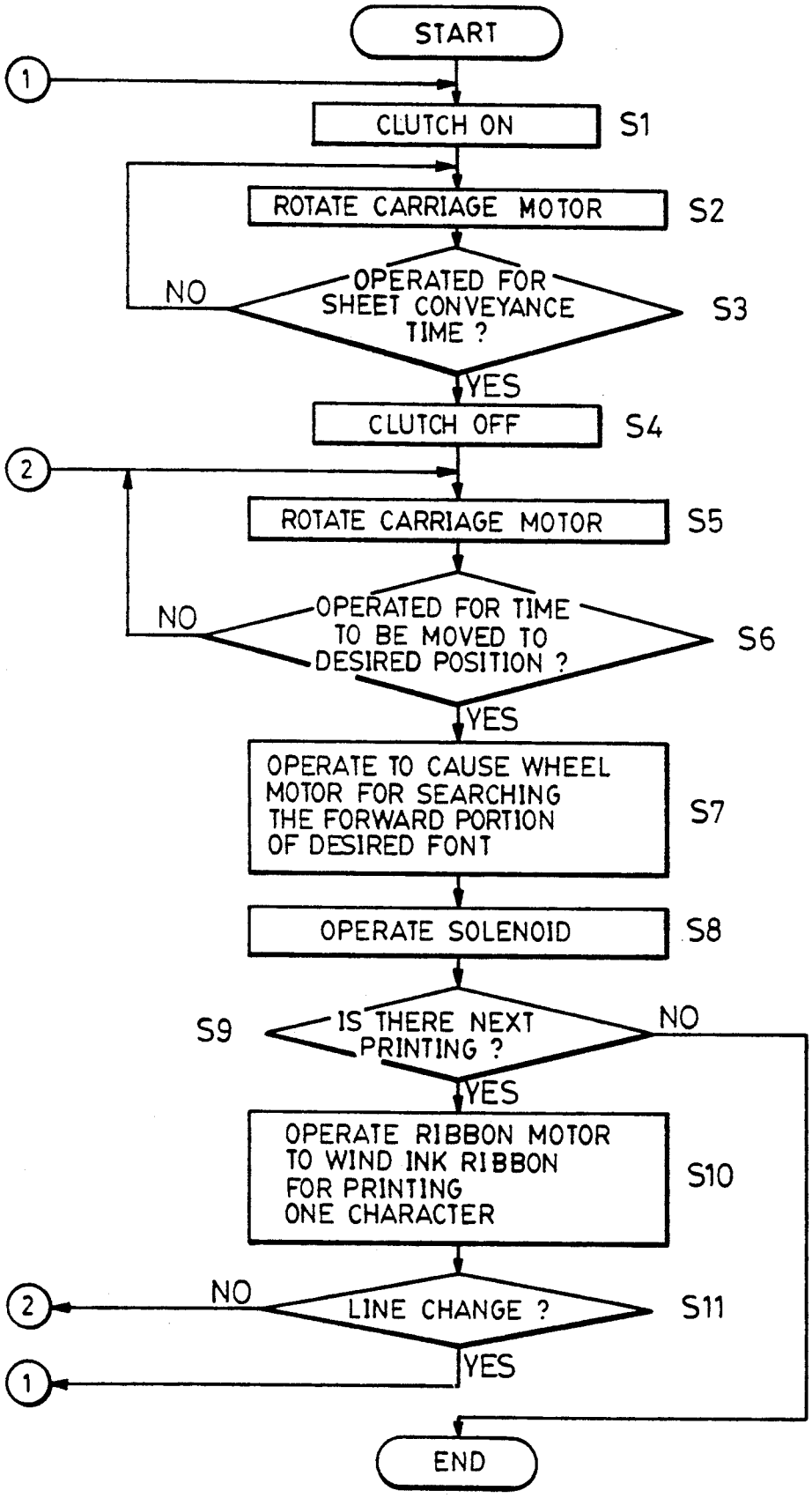
FIG. 11 is a control flow chart.

The sequential operation of each of the members at the time of printing which are controlled by the control means will be described with reference to a flow chart shown in FIG. 11 and a timing chart shown in FIG. 12. According to this embodiment, the operations are controlled by controlling the time by using the timer 15.

When a print start signal is received, the clutch 41 is engaged in step S1 (at time $t_1$ shown in FIG. 12) so that the carriage motor 38 and the platen roller 7*a* are connected to each other. In steps S2 and S3, the carriage motor 38 is rotated for a predetermined time (time $t_2$ to $t_3$ shown in FIG. 12) so that the recording sheet 6 is conveyed so as to confront the printing position of the recording sheet 6 with the daisy wheel 3*a*. The process to be conducted in steps S1 to S3 are called a "sheet conveyance process".

Then, in step S4 (at time $t_4$ shown in FIG. 12), the clutch 41 is released so that the platen roller 7*a* cannot be rotated even if the carriage motor 8 is rotated. In steps S5 and S6, the carriage motor 38 is rotated for a predetermined time (time $t_5$ to $t_6$ shown in FIG. 12) so that the carriage 2 is moved to a desired position, that is the recording position. At this time, the carriage 2 has been moved by a certain degree (position $P_2$ shown in FIG. 12) corresponding to the amount of the rotation of the carriage motor 38 from the previous recording position (position $P_1$ shown in FIG. 12) at the time of the sheet conveyance process. Therefore, at the time of the movement of the carriage, the amount of the rotation of the carriage motor 38 in steps S5 and S6 is determined by the time taken to move from the previous position $P_2$ of the carriage 2 to the recording position (position $P_3$ shown in FIG. 12). That is, the carriage motor 38 is rotated by a degree calculated by subtracting the amount of the movement of the carriage which has been moved in the above-described sheet conveyance process from the amount of the movement from the previous recording position $P_1$ and the desired recording position $P_3$. The above-described steps S4 to S6 constitute the carriage movement process in which the carriage 2 is moved to the recording position.

Then, in steps ensuing from S7, the recording process is performed. First, in step S7, the wheel motor 3*d* is rotated so that a desired type is made to confront the hammer 3. In step S8, the solenoid 17 is operated so that the above-described desired type is stuck by the hammer 3*c*. As a result, printing to the recording sheet 2 is performed. In next step S9, it is determined whether or not there is a next printing. If there is no next printing, the process is ended. If there is a next printing, the flow advances to step S10 in which the ribbon motor M is rotated by a predetermined degree so that the ink ribbon 1*b* is advanced. Then, in step S11, it is determined whether a line change is required before the next printing is performed. If a line change is required, the flow returns to step S1. If a line change is not required, the flow returns to step S5.

As described above, according to this embodiment, the carriage 2 is successively moved from the carriage position realized by the sheet conveyance process to a desired position. Therefore, the carriage 2 can be efficiently and quickly moved to the desired recording position, causing the recording speed to be raised significantly.

Fourth Embodiment

Figure 13:
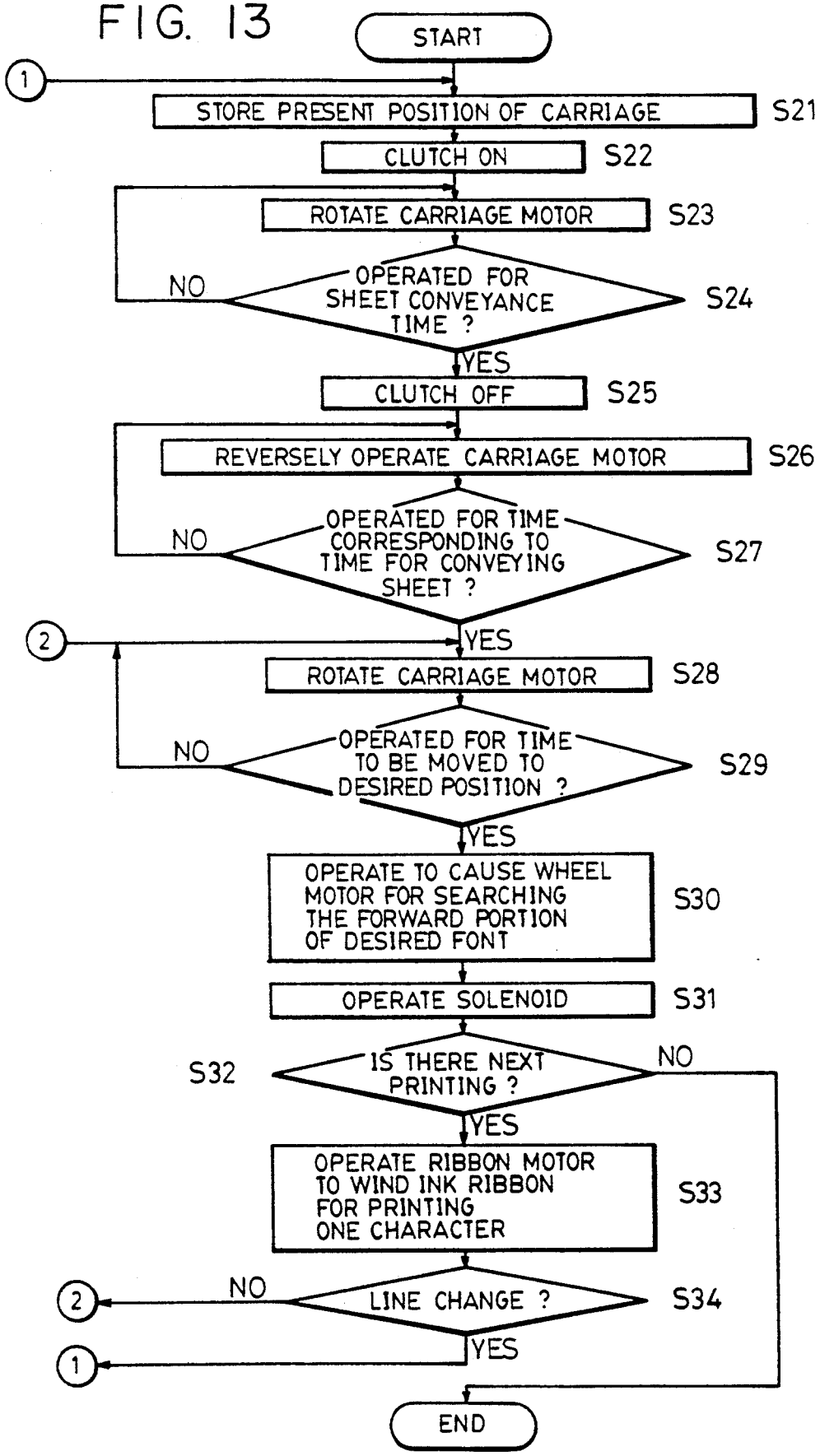
FIG. 13 is a control flow chart according to a fourth embodiment.
Figure 14:
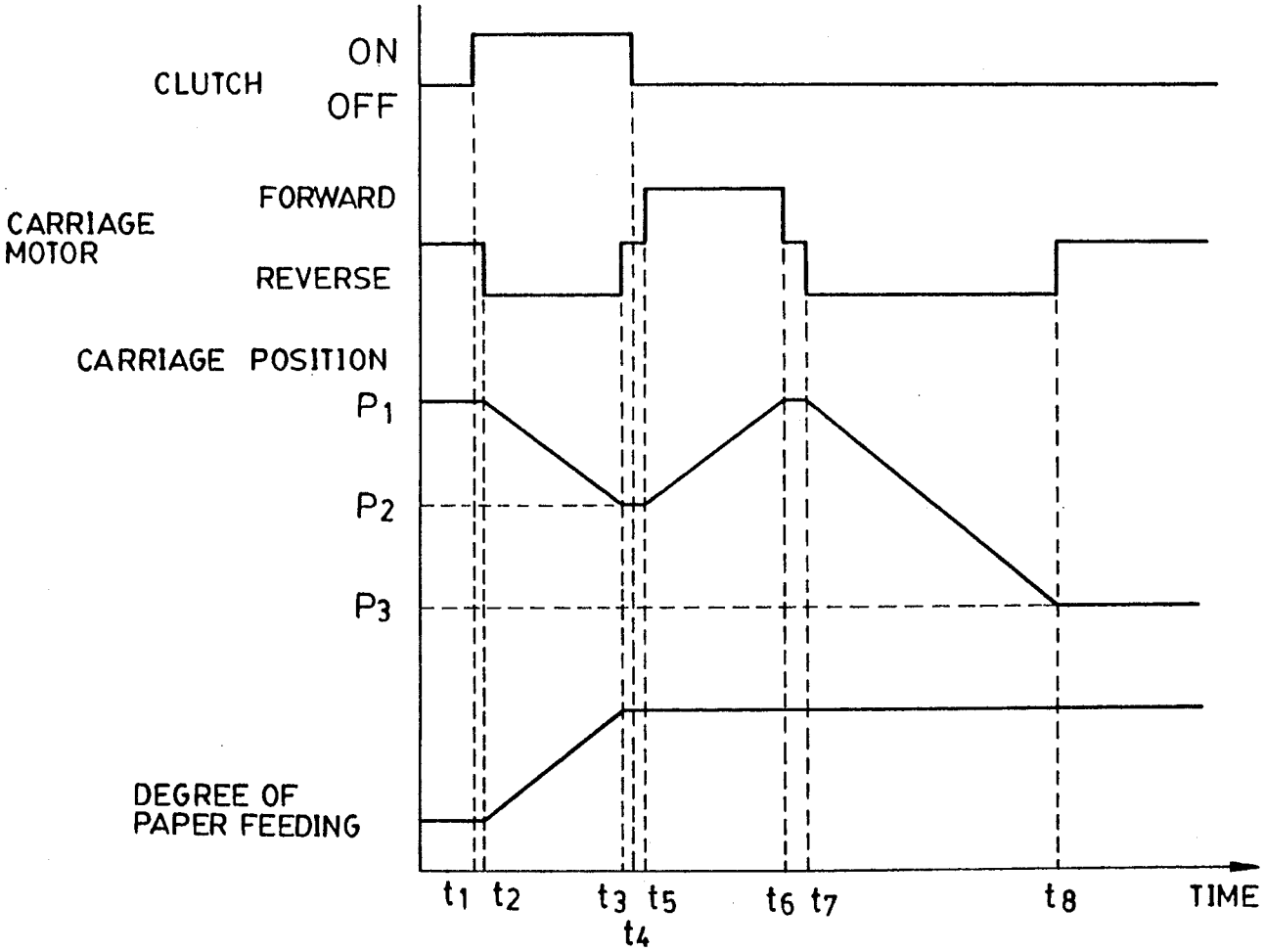
FIG. 14 is an operation timing chart of the same.

FIG. 13 is a flow chart and FIG. 14 is an operation timing chart according to a fourth embodiment arranged in such a manner that, when recording is performed by the above-described recording apparatus, the carriage which has been moved in the above-described sheet conveyance process is temporarily returned to the previous recording position before the same is moved to a desired recording position.

According to that control procedure, when a recording signal is supplied, the present position (position $P_1$ shown in FIG. 14) of the carriage 2 is stored in the working area of the RAM 14 in step S21. In step S22 (at time $t_1$ shown in FIG. 14), the clutch 41 is engaged so that the carriage motor 38 and the platen roller 7*a* are connected to each other. In steps S22 and S23, the carriage motor 38 is rotated for a predetermined time (from time $t_2$ to $t_3$ shown in FIG. 14) so that the recording sheet 6 is conveyed so as to have the recording position which confronts the daisy wheel 3*a*. The steps S22 to S24 are the sheet conveyance process.

In step S25 (at time t4 shown in FIG. 12), the clutch 41 is released so that the platen roller 7*a* cannot be rotated even if the carriage motor 38 is rotated. In steps S26 and S27, the carriage motor 38 is reversely rotated for a time (time $t_5$ to $t_6$ shown in FIG. 14) which corresponds to the above-described sheet conveyance time. As a result of the above-described sheet conveyance process, the carriage 2 has been moved for a distance (to the position $P_2$ shown in FIG. 14) corresponding to the amount of the rotation of the carriage motor 38 in the sheet conveyance process. The carriage 2 is returned to the original position $P_1$ as a result of the reverse rotation of the carriage motor 38. The steps S25 to S27 constitute the correction process.

Then, in steps S28 and S29, the carriage movement process is performed. That is, when the carriage motor 38 is rotated for a predetermined time (time $t_7$ to $t_8$ shown in FIG. 14) so as to move the carriage 2 to a desired position, that is, the recording position. Therefore, the carriage 2 is moved from the previous recording position $P_1$ to the next recording position $P_3$.

Then, in the ensuing processes from step S30, the recording process is performed. However, it is the same process as that according to the first embodiment, the description of which is omitted here.

As a result of the control of the movement of the carriage 2, correct movement of a carriage can be realized in an apparatus in which the carriage 2 is arranged to move in units equal to the size of the character (for example, 10/120 inch) even if the carriage 2 has been stopped at an incorrect position which does not correspond to the size of the character because the carriage is moved from the previous recording position at the recording.

In a case where the amount of the movement of the carriage in the above-described sheet conveyance process is smaller than the original minimum resolution of the carriage, the position cannot be corrected by simply operating the carriage motor 8. An embodiment in which the above-described correction can be realized will now be described. That is, a process necessary when the carriage movement distance in steps S4 to S6 is smaller than the original minimum resolution of the carriage will be described. As described above, the movement of the carriage of a printing apparatus is usually arranged to be made in units equal to a half character. However, a major portion of usual printing apparatuses are arranged to be capable of printing with a plurality of fonts. Also according to this embodiment, a plurality of fonts can be used by interchanging the daisy wheel 3a. However, the term "Font" also means the size as well as the style. Specifically, the above-described type arranged in such a manner that one character = 10/120 inch is called "elite". In addition, "pica" type arranged in such a manner that one character = 12/120 each can be used. In the case where elite is used, the printing positions in units equal to a half character is controlled at 5/120 inch, while the same printing positions in the case of pica are controlled at 6/120 inch. Therefore, the carriage movement distance can be controlled in units of 6/120 inch in addition to units of 1/120 inch according to this embodiment.

Since a mechanical backlash is involved when the carriage 2 is moved in an actual printing operation, it is necessary that a slight amount of movement must be added to the usual amount of the movement when the carriage 2 is moved to the left when a line change or the like is performed, while the carriage may be simply moved to the right by 5/120 inch in the normal printing in the right direction. Specifically, an amount of offset of about 1/120 inch is added in the printing apparatus according to this embodiment.

Therefore, the printing apparatus according to this embodiment comprises a movement control means capable of corresponding to the carriage movement distances in units of 5/120 inch, 6/120 inch, 5/120 inch + 2/120 inch and 6/120 inch + 2/120 inch. Specifically, in units of 1/120 inch, they are 5, 6, 7, 8, 10, 12, 14, 15, 17, 18, 20, 22, . . . Furthermore, the rotation of the carriage motor 8, which is a pulse motor and which acts to move the carriage 2 is controlled while classifying the stages into acceleration, constant speed and deceleration. The above-described control is arranged to be in the form of a trapezoid in which the speed is gradually raised and is gradually lowered. However, one cannot simply deduce the speed by using a formula in an actual printing apparatus since a variety of factors must be taken into consideration such as the mechanical friction, movement and backlash and the like. Therefore, an individual data table is provided which stores information about the acceleration, constant speed and deceleration for each amount of the movement of the carriage (FIG. 17 shows an example of the data table). FIG. 17 also shows the distance of the movement at the time of the acceleration, constant speed and the deceleration and each relative excitation time. The total relative switch signals given to the motor until the above-described three stages have been ended effects the movement distance of the carriage 2. However, the actual control software does not have individual control tables which correspond to all of the above-described distances of the movement. The reason for this lies in that the states of the acceleration and the deceleration are not realized and only the constant speed region extends in the case of a distance of the movement exceeding a certain degree. Therefore, the number of the constant speed regions is changed on the program of the same control table in the case where the distance of the movement exceeds a certain distance. Specifically, a common table is subjected to a reference in the case where the distance of the movement of the carriage exceeds 12/120 inch (FIG. 18 shows an example of the common table).

The distances of the movement which can be realized by the carriage 2 are, in units of 1/120 inch, 5, 6, 7, 8, 10, 12, 14, 15, 17, 18, 20 . . . . However, individual control tables for the distances shorter than 12/120 inch are arranged to successively exist from 5/120 inch to 12/120 inch, except for 9/120 inch and 11/120 inch.

In this case, control software can be significantly easily manufactured which comprises all of the individual control tables from 5/120 inch to 12/120 inch to be controlled by the same process in comparison to manufacturing both control software comprising individual tables from 5/120 inch to 12/120 inch from which only 9/120 inch and 11/120 inch are removed and control software for controlling the 9/120 inch and 11/120 inch increments.

As a result, according to the printing apparatus according to this embodiment, any movement distance shorter than 12/120 inch is controlled by individual tables from 5/120 inch to 12/120 inch (FIG. 19 shows an example of the individual table) while the movement distance exceeding 12/120 inch is controlled by using the common table (see FIG. 18). As a result, the carriage can be optionally moved to a distance exceeding 5/120 inch.

Therefore, according to this embodiment, the movement of the carriage by a distance shorter than the minimum resolution (5/120 inch), in an apparatus in which this feature was not originally incorporated, is realized by combining the above-described plurality of movement control means.

Figure 12:
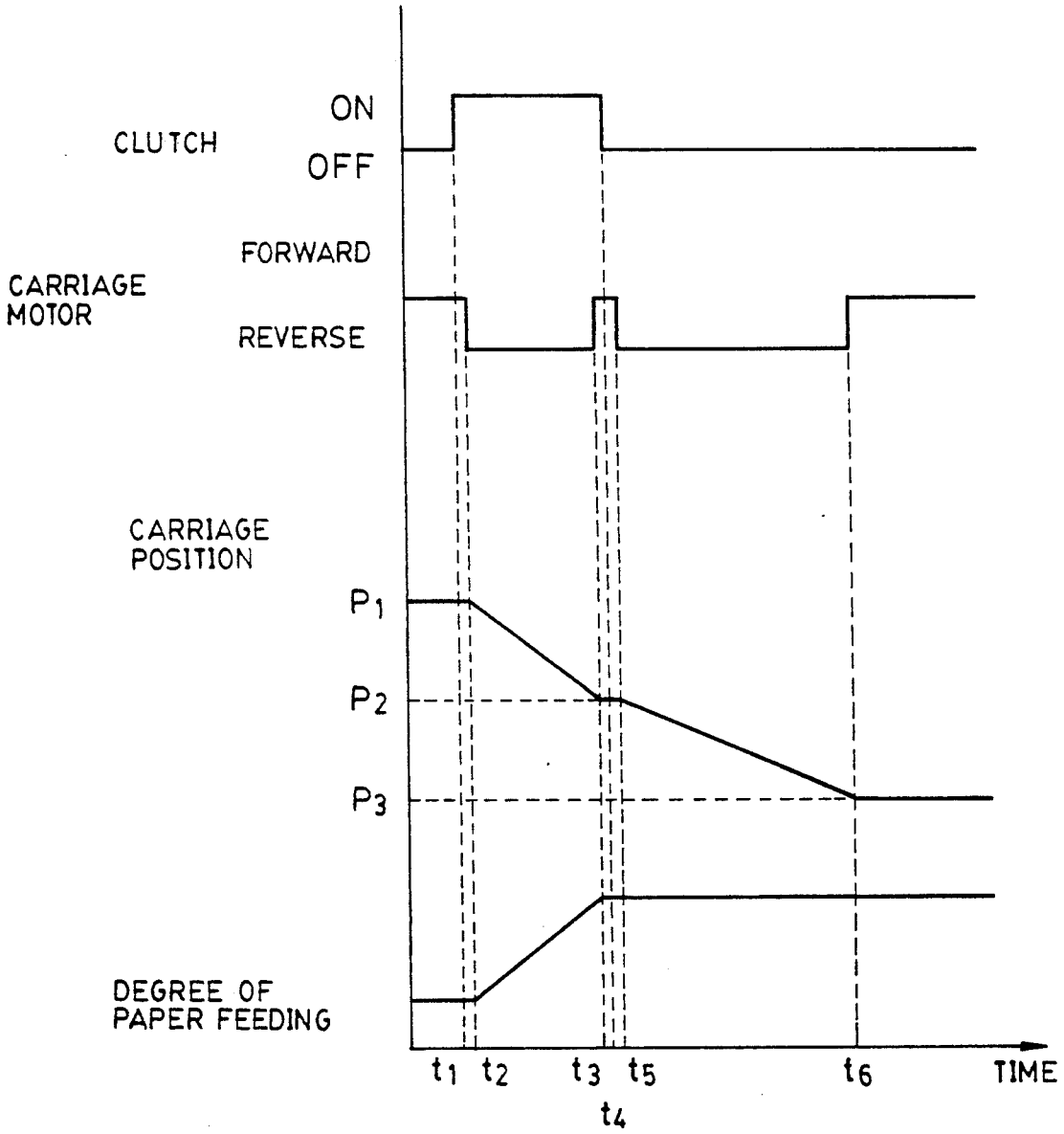
FIG. 12 is an operation timing chart of the same.

Referring to FIG. 12, the carriage 2 has been moved from position $P_1$ to $P_2$ in the sheet conveyance process. In order to correspond to a case where the distance $P_3—P_2$, which is the distance to the next carriage position $P_3$, is smaller than the minimum movement distance $C_{min}$ of the carriage, steps S5 and S6 are arranged to be steps S40 to S52 shown in a flow chart shown in FIG. 15.

First, in step S40, it is determined whether or not the distance $P_3—P_2$ to the desired position is smaller than the minimum distance $C_{min}$ of the carriage. If it is smaller, it is determined that the moving direction is left in step S41. If the moving direction is left, the carriage 2 is moved to the left by $(P_3-P_2)+C_{min}$+amount of backlash correction. Then, in step S43, the backlash is removed. Specifically, it can be realized by moving the carriage 2 to the right by using an individual table exclusively used for removing backlash (see FIG. 20). Finally, the carriage 2 is moved to the right by $C_{min}$ in step S44 so that the carriage 2 is brought to the desired position $P_3$.

Then, if it has been determined, in step S41, that the moving direction is right, the carriage 2 is moved to the right in step S46 by $(P_3-P_2)+C_{min}$. Then, in step S47, the carriage 2 is moved to the left by $(P_3-P_2)+C_{min}$+amount of backlash correction. Finally, the backlash is removed in step S48. The process steps ensuing from step S49 are the process steps performed when the distance $P_3-P_2$ is larger than the minimum movement distance $C_{min}$ of the carriage 2, which is the usual carriage correction process. In step S49, the moving direction is examined. If it is left, the carriage is, in step S50, moved to the left by $(P_3-P_2)+C_{min}$+amount of backlash correction. Then, in step S51, the backlash is removed and the process is ended. In the case where the carriage moving direction is right, the carriage is, in step S52, moved to the right by $(P_3-P_2)$ and the process is ended.

As described above, according to this embodiment, if the movement distance of the carriage is smaller than the minimum resolution after the sheet has been conveyed, the ensuing printing can be normally continued.

Sixth Embodiment

A sixth embodiment will now be described. According to the fifth embodiment, if the movement distance of the carriage is smaller than the minimum resolution after the sheet has been conveyed, it can be overcome by the process steps ensuing from step S41 shown in FIG. 15. According to this embodiment, a further efficient processing means is provided.

According to the fifth embodiment, if it has been determined, in step S41, that the moving direction is right, the processes in steps S46 to S48 are performed. However, the total amount of the movement is equal to the values calculated by adding the amount of the correction of the backlash. Therefore, the carriage 2 is moved by a distance which is larger than the actually necessary distance of the movement by the amount of the backlash correction. Therefore, according to the sixth embodiment, a means is provided for moving the carriage 2 by a degree which is the distance obtained by previously subtracting the amount of the backlash correction.

Figure 15:
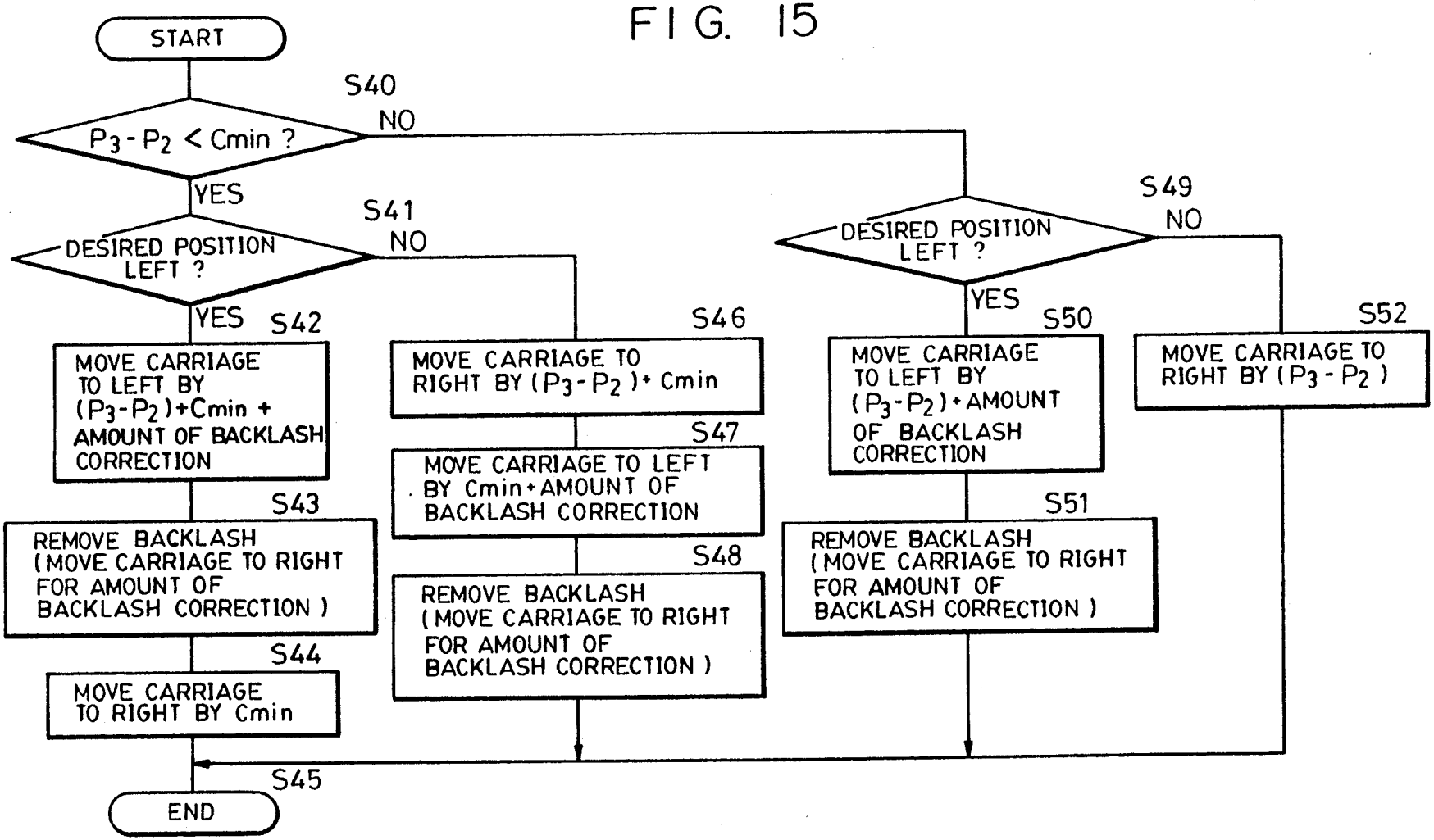
FIGS. 15 and 16 are flow charts of fifth and sixth embodiments.
Figure 16:
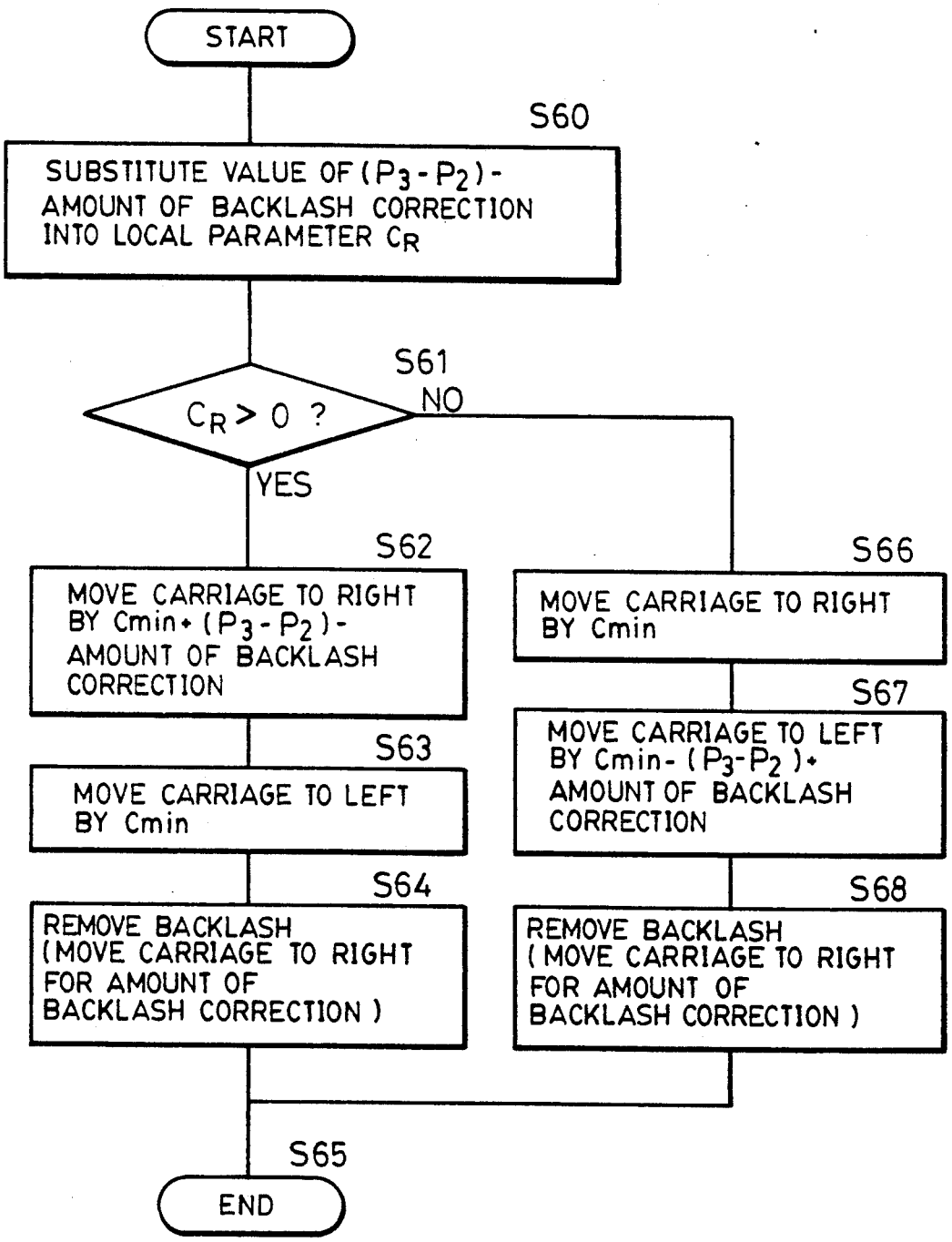

FIG. 16 is a flow chart of the means according to this embodiment which corresponds to steps S46 to S48 shown in FIG. 15.

If it has been, in step S41, determined that the moving direction is right, $(P_3-P_2)$ − amount of backlash correction is calculated in step S60. Then, the sign of the result of this calculation is examined in step S61, wherein it is determined whether the distance to the desired position is larger than the amount of the backlash correction. If it has been determined that the result is a positive value, the carriage 2 is moved to the right by $C_{min}+(P_3-P_2)$ + amount of backlash correction. Then, in step S63, the carriage 2 is moved to the left by $C_{min}$. Finally, the backlash is removed in step S64 and the process is ended in step S65.

If the result is negative in step S61, the carriage 2 is moved to the right by $C_{min}$ in step S66 before the carriage 2 is moved to the left by $C_{min}-(P_3-P_2)$ + amount of backlash correction in step S67. Finally, the backlash is removed in step S68 and the process is ended in step S65.

As described above, according to this embodiment, although the determination conditions become complicated, the amount of the movement of carriage 2 can be reduced in comparison to that according to the fifth embodiment. Therefore, the printing can be performed at a higher speed.

The recording direction and the sheet conveying direction are not limited to those described in the above embodiments. They can be set accordingly.

Furthermore, since the recording means is not limited to the above-described daisy wheel recording method, another recording method such as a wire dot recording method, ink jet recording method or thermal recording method may be employed.

According to the above-described embodiments, the sheet is conveyed by the platen roller which also serves as the platen. However, the sheet may be conveyed by a separate roller other than the platen. In addition, the conveying means is not limited to the roller type means. For example, the sheet may be conveyed by a conveyance belt or the like.

According to the above-described embodiments, the switching means comprises an electromagnetic clutch. It may, of course, be replaced by a mechanical clutch or the like.

If the ink jet recording method is employed as the recording method in the present invention, an excellent effect can be obtained in selecting the bubble jet type recording head and recording apparatus suggested by Canon Inc. In this case, dense and precise recording can be realized.

It is preferable that the basic principle disclosed in U.S. Pat. No. 4,723,129 and U.S. Pat. No. 4,740,796 be employed as the representative structure and the principle of ink jet recording. The thus disclosed method can be applied to both the so-called on-demand type and the continuous type. In particularly, it is effective when use is made of the on-demand type structure which is arranged in such a manner that at least one drive signal, which effects a temperature rise exceeding the nucleate boiling of a liquid and corresponds to the information to be recorded, is applied to an electrothermal converter positioned to correspond to a liquid passage in which a liquid (ink) is held. As a result, thermal energy is generated in the electrothermal converter, causing film boiling. As a result, bubbles respectively corresponding to the above-described drive signals can be formed in the liquid (ink). In accordance with the enlargement/contraction of the bubble, the liquid (ink) is discharged through the discharge port so that at least one droplet is formed. In the case where the above-described drive signal is in the form of a pulse, the enlargement/contraction of the bubble can be quickly and properly made. Therefore, the liquid (ink) can be discharged with a good response. As the pulse drive signal, drive signals disclosed in U.S. Pat. No. 4,463,359 and U.S. Pat. No. 4,345,262 can be preferably employed. Furthermore, if the conditions disclosed in U.S. Pat. No. 4,313,123 relating to the ratio of the temperature rise of the above-described heat acting surface are employed, further improved recording can be performed.

The above-disclosed structures of the recording head are arranged in such a manner that the discharge port, the liquid passage and the electrothermal converter are combined (a linear liquid passage or a perpendicular liquid passage) with other structures disclosed in U.S. Pat. No. 4,558,333 and U.S. Pat. No. 4,459,600. The above combination is arranged in such a manner that the heat acting portion is disposed in a bent portion of the liquid passage. These features are included in the scope of the present invention. In addition, the present invention can effectively be applied both to a structure disclosed in Japanese Patent Laid-Open No. 59-123670 in which a recording head is arranged in such a manner that a common slit is made to be the discharge portion of the electrothermal converter and to another structure disclosed in Japanese Patent Laid-Open No. 59-138461 in which a recording head is arranged in such a manner that an aperture capable of absorbing the pressure wave of the thermal energy is made to correspond to the discharge portion. That is, according to the present invention, recording can be efficiently performed regardless of the shape of the recording head.

Furthermore, the present invention can be effectively applied to a full line type recording head having a length which corresponds to the maximum width of the recording medium to which data can be recorded by the recording apparatus. As the recording head of the type described above, the structure may be arranged in such a manner that the length can be achieved either by combining a plurality of recording heads or by a sole integrated type recording head.

In addition, the present invention can be effectively applied to serial type recording heads, in particular, to a recording head which is secured to the apparatus body and a recording head of an interchangeable type arranged to be mounted on the apparatus body so as to establish the electrical connection with the apparatus body and enable the supply of ink from the apparatus body. Furthermore, the present invention can also effectively be applied to a recording head of a cartridge type arranged in such a manner that the ink tank is integrally formed with the recording head similarly to the above-described examples.

Furthermore, if a restoring means or a support means for the recording head of the recording apparatus according to the present invention is provided, the effect of the present invention can be further stabilized. Specifically, it is preferable that the recording head be provided with a capping means, a cleaning means, a pressure or suction means, an electrothermal converter or another heating device or a preliminary heating means incorporated in the structure of the above-described elements. In addition, a structure operable in a sub-discharge mode capable of individual discharge of a liquid from the discharge opening can be effectively employed.

As for the type and the number of the recording heads, one recording head may be arranged corresponding to a monocolor ink. In addition, a plurality of recording heads may be provided so as to correspond to a plurality of ink types having different colors and densities. That is, the present invention can significantly effectively be applied to an apparatus of a plural color type or a full color type, which is realized by the recording mode of mixing colors in addition to the recording mode of the main color such as black, the plural color and the full color type apparatus being realized by integrally forming the recording head or by combining a plurality of recording heads.

According to the embodiments of the present invention, ink in the form of a liquid is normally employed. However, ink of the type which is solidified at room temperature or lower and softened or liquified at room temperature may be employed. Furthermore, in the ink jet recording method, the structure is usually arranged in such a manner that the temperature is controlled in a range between 30° C. to 70° C. so as to make the viscosity of ink to be within a stable discharge range. Therefore, ink which can be liquified in accordance with the temperature control performed at the time when the recording signal is supplied can be employed. In addition, the present invention can be effectively applied to a structure arranged in such a manner that the temperature rise due to the generated thermal energy is utilized so as to change the state of the ink from the solid phase to the liquid phase. Furthermore, a structure arranged in such a manner that the ink which can be solidified when it is allowed to stand is used for the purpose of preventing the evaporation of the ink. The ink can be liquified so that liquid ink is discharged when thermal energy generated in response to the recording signal. In addition, the present invention can be applied to a structure in which the ink which can be liquified by thermal energy is of the type which again solidifies when it reaches the recording medium. In each of the above-described cases, the ink may be stored in the form of a solid in a recessed portion of a porous sheet or a through hole in such a manner that the ink confronts the electrothermal converter as disclosed in Japanese Patent Laid-Open No. 54-56847 or Japanese Patent Laid-Open No. 60-71260. According to the present invention, the most preferable structure to use the above-described ink is the structure which employs the above-described film boiling method.

Furthermore, the ink jet recording apparatus according to the present invention may be the image output terminal of an information processing apparatus such as a computer, a copying machine formed by combining reading machines and a facsimile having signal transmitting/receiving functions.

As described above, according to the present invention, a recording apparatus the size of which can be reduced and capable of high speed recording is provided.

Although the invention has been described in its preferred form with a certain degree of particularly, it is understood that the present disclosure of the preferred form may been changed in the details of construction and the combination and arrangement of parts may be resorted to without departing from the spirit and the scope of the invention as hereinafter claimed.

What is claimed is:

1. A recording apparatus for recording data on a recording medium, said apparatus comprising:

a conveyance passage through which a recording medium passes;

recording means capable of moving along said conveyance passage through which the recording medium passes and recording data on the recording medium;

conveyance means for conveying the recording medium through said conveyance passage;

moving means for moving said recording means along said conveyance passage;

a driving source for generating driving power;

first transmission means for transmitting the power from said driving source to said conveyance means;

second transmission means for transmitting the power from said driving source to said moving means;

shifting means for selectively connecting and disconnecting said first transmission means and said driving source while maintaining a connection between said driving source and said second transmission means; and control means for controlling both a medium conveyance process in which the recording medium is conveyed by transmitting the power from said driving source to said medium conveyance means via said shifting means and a recording means movement process in which said shifting means does not transmit the power to said medium conveyance means and said driving source is operated so as to correct the amount of the movement of said recording means which has been moved as a result of the medium conveyance process.

2. A recording apparatus according to claim 1, wherein said shifting means comprises a serration gear, a clutch gear and a solenoid.

3. A recording apparatus according to claim 1, wherein said second transmission means also serves as a portion of said first transmission means.

4. A recording apparatus according to claim 1, wherein said first transmission means comprises a bevel gear and an intermediate gear.

5. A recording apparatus according to claim 1, wherein said second transmission means comprises a bevel gear.

6. A recording apparatus according to claim 1, wherein said recording means comprises a daisy wheel.

7. A recording apparatus according to claim 1, wherein said recording means includes a discharge port and uses ink in an ink jet recording method in which thermal energy is utilized so as to discharge the ink through said discharge port to record.

8. A recording apparatus according to claim 1, wherein said recording means includes discharge ports and electrothermal converters and discharges ink through said discharge ports by growth of bubbles due to film boiling caused by heat energy generated by said electrothermal converters.

9. A recording apparatus for recording data on a recording sheet, said recording apparatus comprising:

a conveyance passage through which a recording sheet passes;

a carriage capable of moving along said conveyance passage through which the recording sheet passes;

recording means mounted on said carriage for recording data on the recording sheet;

a driving source for generating driving force;

sheet conveyance means for conveying the recording sheet;

carriage moving means for moving said carriage by the force supplied from said driving source;

power transmission means for transmitting force from said driving source to said sheet conveyance means;

shifting means for selectively transmitting the force to said sheet conveyance means via said power transmitting means; and control means for controlling both a sheet conveyance process in which the recording sheet is conveyed by transmitting the force from said driving source to said sheet conveyance means via said shifting means and a carriage movement process in which said shifting means does not transmit the force to the sheet conveyance means and said driving source is operated so as to correct the amount of the movement of said carriage which has been moved as a result of the sheet conveyance process.

10. A recording apparatus for recording data on a recording sheet, said recording apparatus comprising:

a conveyance passage through which a recording sheet passes;

a carriage capable of moving along said conveyance passage through which the recording sheet passes, said carriage movable between a stop position and recording positions;

recording means mounted on said carriage for recording data on the recording sheet;

a driving source for supplying a driving force;

sheet conveyance means for conveying the recording sheet;

carriage moving means for moving said carriage by the force supplied from said driving source in increments of at least a minimum printing resolution;

power transmission means for transmitting the force from said driving source to said sheet conveyance means;

shifting means for selectively transmitting the force to said sheet conveyance means via said power transmission means; and control means for controlling both a sheet conveyance process in which the recording sheet is conveyed by transmitting the force from said driving source to said carriage moving means and said sheet conveyance means via said shifting means and a carriage movement process in which said shifting means does not transmit the force to the sheet conveyance means and said carriage is moved, wherein said driving source is operated in the carriage movement process such that said carriage moving means moves said carriage to a desired recording position, even if the distance between a position to which said carriage is moved in said sheet conveyance process and the desired recording position is less than the minimum printing resolution of said carriage moving means.

11. A recording apparatus for recording data on a recording sheet, said recording apparatus comprising:

a conveyance passage through which a recording sheet passes;

a carriage capable of moving along said conveyance passage through which the recording sheet passes;

recording means mounted on said carriage for recording data on the recording sheet;

a driving source for supplying a driving force;

sheet conveyance means for conveying the recording sheet;

carriage moving means for moving said carriage in increments of at least a minimum printing resolution by the force supplied from said driving source;

power transmission means for transmitting the force from said driving source to said sheet conveyance means;

shifting means for selectively transmitting the force to said sheet conveyance means via said power transmitting means; and control means for controlling each of a sheet conveyance process is which the recording sheet is conveyed by transmitting the force from said driving source to said carriage moving means and said sheet conveyance means via said shifting means, and a correction process in which said shifting means does not transmit the force to the sheet conveyance means, wherein said driving source is operated in the correction process to a degree to compensate for the distance said carriage moves in said sheet conveyance process, even if the distance between a position of said carriage at the end of said sheet conveyance process and a desired recording position is less than the minimum printing resolution of said carriage moving means, and a carriage movement process in which said driving source is, after said correction process, operated to a degree to move said carriage to the desired recording position.

12. A recording apparatus according to any one of claims 9, 10 and 11, wherein said recording means comprises a daisy wheel.

13. A recording apparatus according to any one of claims 9, 10 and 11, wherein said recording means includes a discharge port and uses an ink jet recording method in which thermal energy is utilized so as to discharge ink through said discharge port to record.

14. A recording apparatus according to any one of claims 9, 10 and 11, wherein said recording means includes electrothermal converters and discharge ports and discharges ink through said discharge ports by growth of bubbles due to film boiling caused by heat energy generated by said electrothermal converters.

15. A recording apparatus according to any one of claims 9, 10 and 11, further comprising an individual table and a common table, wherein said carriage movement process is performed by said control means selecting data from the individual table and the common table.

16. A recording apparatus according to any one of claims 9, 10 and 11, wherein said control means comprises an individual data table exclusively used for removing backlash.

* * * * *

UNITED STATES PATENT AND TRADEMARK OFFICE

CERTIFICATE OF CORRECTION

PATENT NO. : 5,184,902 Page 1 of 2

DATED : February 9, 1993

INVENTOR(S) : Tsutomu Harada, et al.

It is certified that error appears in the above-indentified patent and that said Letters Patent is hereby corrected as shown below:

On the Title Page:

AT [30] FOREIGN APPLICATION PRIORITY DATA:

"Nov. 26, 1989 [JP] Japan.....2-317746"

should read

--Nov. 26, 1990 [JP] Japan .....2-317746--.

COLUMN 4:

Line 9, "be" should be deleted.

COLUMN 11:

Line 49, "stuck" should read --struck--.

COLUMN 12:

Line 23, "time t4" should read --time $t_4$--.

COLUMN 13:

Line 10, "each" should read --inch--.

UNITED STATES PATENT AND TRADEMARK OFFICE

CERTIFICATE OF CORRECTION

PATENT NO. : 5,184,902 Page 2 of 2

DATED : February 9, 1993

INVENTOR(S) : Tsutomu Harada, et al.

It is certified that error appears in the above-indentified patent and that said Letters Patent is hereby corrected as shown below:

COLUMN 16:

Line 16, "particularly," should read --particular,--.

COLUMN 18:

Line 20, "particularly," should read --particularity,--;

Line 22, "been" should read --be--.

COLUMN 20:

Line 38, "of" should read --of (a)--;

Line 43, "and" should read --and (b)--;

Line 52, "and" should read --and (c)--.

Signed and Sealed this

Fourth Day of October, 1994

*Attest:*

Bruce Lehman

BRUCE LEHMAN

*Attesting Officer*

*Commissioner of Patents and Trademarks*